United States Patent [19]

Stucki

[11] Patent Number: 5,042,686

[45] Date of Patent: Aug. 27, 1991

[54] DEVICE FOR DISPENSING GOODS AND USE THEREOF

[76] Inventor: Andre Stucki, Rüti, CH-5704 Egliswil, Switzerland

[21] Appl. No.: 379,772

[22] Filed: Jul. 14, 1989

[30] Foreign Application Priority Data

Jul. 23, 1988 [CH] Switzerland ..... 02816/88

[51] Int. Cl.[5] ..... G07F 11/00

[52] U.S. Cl. ..... 221/13; 194/217; 221/79; 414/273

[58] Field of Search ..... 221/13, 79; 194/217; 414/273; 360/69, 71, 92

[56] References Cited

U.S. PATENT DOCUMENTS

| | | | |
|---|---|---|---|
| 4,271,440 | 6/1981 | Jerkins et al. | 194/906 |
| 4,519,522 | 5/1985 | McElwee | 221/13 |
| 4,668,150 | 5/1987 | Blumberg | 414/273 |
| 4,814,592 | 3/1989 | Bradt et al. | 194/906 |

FOREIGN PATENT DOCUMENTS

| | | | |
|---|---|---|---|
| 0060643 | 9/1982 | European Pat. Off. . | |
| 0249367 | 12/1987 | European Pat. Off. . | |
| 3529155 | 2/1987 | Fed. Rep. of Germany | 194/906 |
| 2559599 | 8/1985 | France . | |
| 2562293 | 10/1985 | France . | |
| 2549624 | 12/1987 | France | 194/906 |
| 55-156107 | 12/1980 | Japan | 194/906 |
| 380926 | 9/1932 | United Kingdom . | |
| 87/00948 | 2/1987 | World Int. Prop. O. | 194/906 |

OTHER PUBLICATIONS

Foreign Patent Documents, Cont. No. 546,823 Date: 11/24/22 France.

*Primary Examiner*—H. Grant Skaggs
*Attorney, Agent, or Firm*—Longacre & White

[57] ABSTRACT

The device has a column-shaped housing (1) in which there is located a storage magazine (7) for goods (8) offered, a goods chute (2) for dispensing and depositing the goods, electromechanical means (*9a–9c*) for transporting the goods between storage magazine and goods chute, as well as a control device (10) formed by a computer. There are provided on the housing, accessible from the outside, an operating panel with a keypad (3) and a display (4) and also a magnetic card reader/-recorder (6). Implemented by means of software in the computer are a user access control and registration system, a goods storage management system and a customer accounting system. The device is designed so that it can both dispense goods selected via the operating panel and take back corresponding goods again, the movements of goods being automatically registered in a user-specific manner. The device can thus be employed as a goods rental machine, especially for videocassettes or the like.

11 Claims, 32 Drawing Sheets

Figure 1:
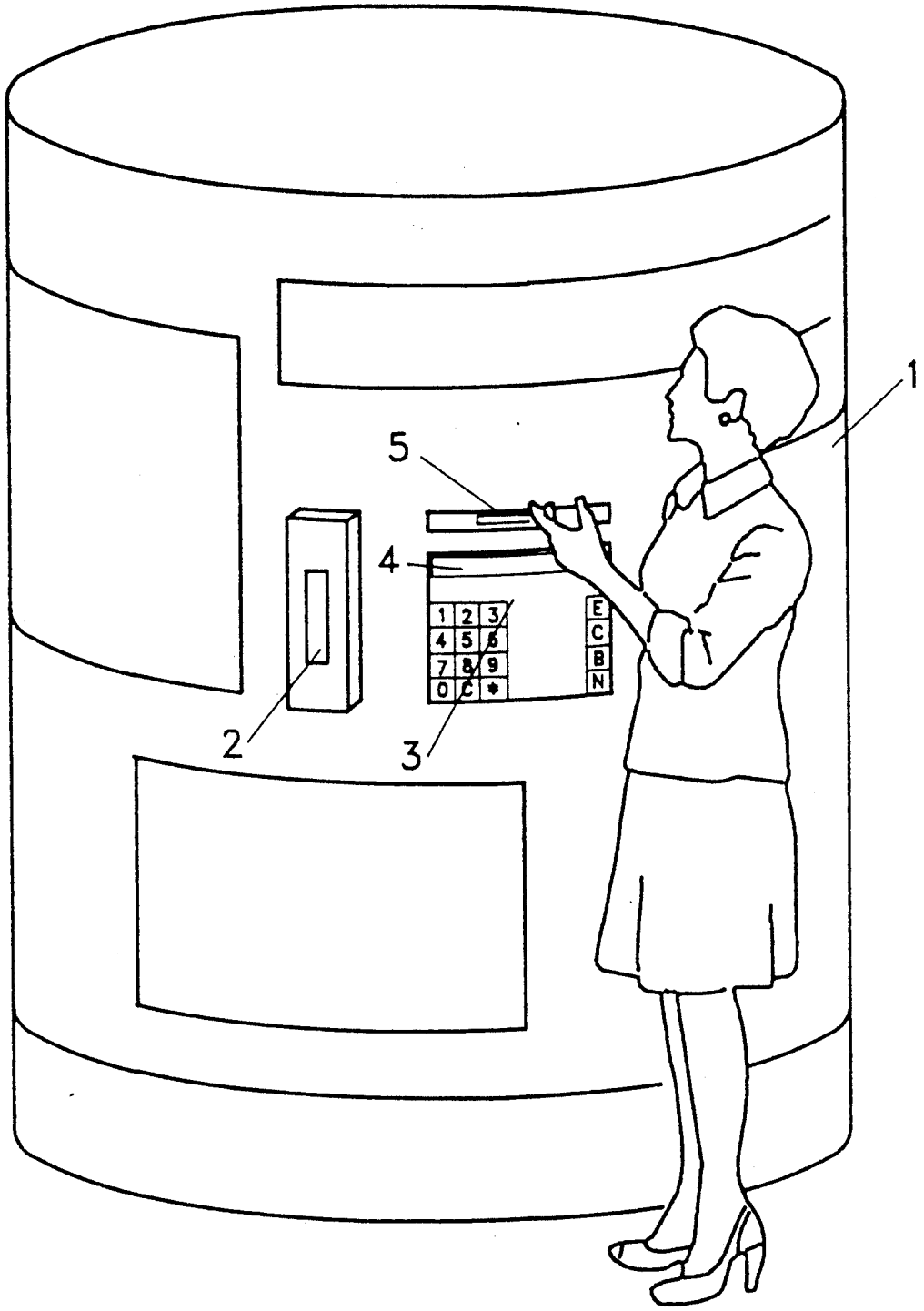

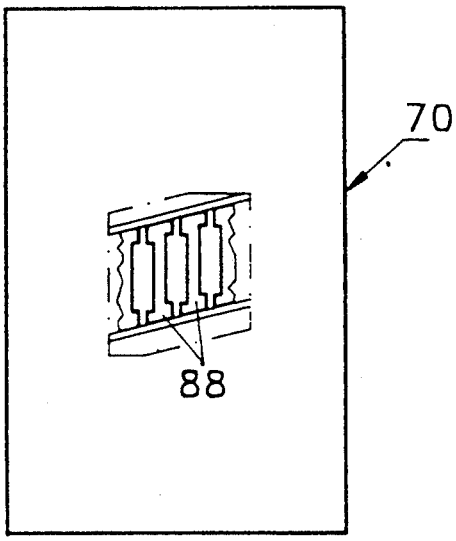
FIG.20
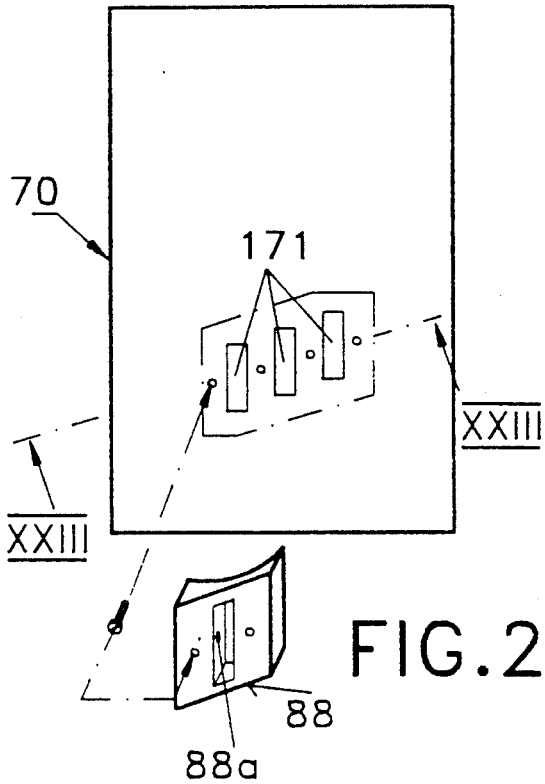
FIG.21
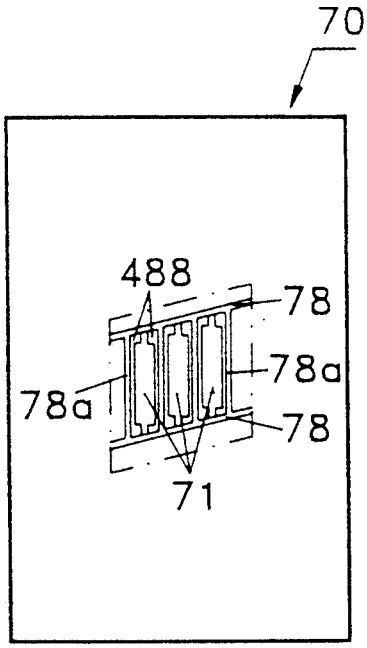
FIG.22
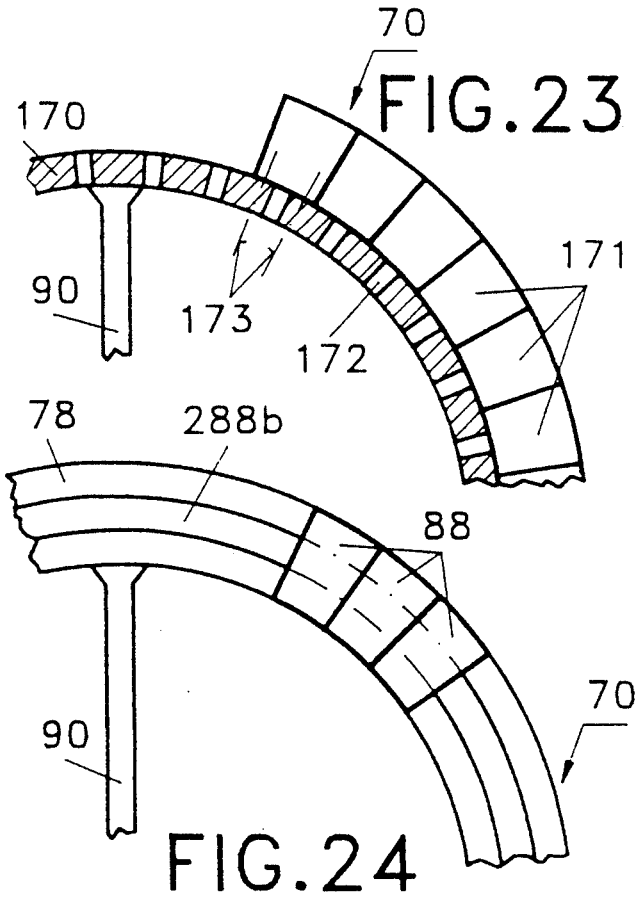
FIG.23
FIG.24

DEVICE FOR DISPENSING GOODS AND USE THEREOF

The invention relates to a device for dispensing goods in accordance with the preamble of Patent Claim 1 as well as to the use thereof.

Such devices, commonly called automatic vending machines, exist in numerous, more or less complicated variations and are employed for the fully automatic selling of the widest variety of goods. Common to all these known vending machines in this context is that they can always only dispense (sell) goods, but can never take back goods.

The present invention intends to rectify this deficiency and further develop a device of the generic type to such an extent that it is also capable of taking back goods in an ordered manner, and hence can be employed also as a rental machine.

The device for dispensing goods according to the invention, which achieves this object, is characterized by the features of claim 1. Advantageous refinements and further developments are obtained from the dependent claims. A particularly preferred use of the device for dispensing goods according to the invention is the subject-matter of claim 10.

Figure 2:
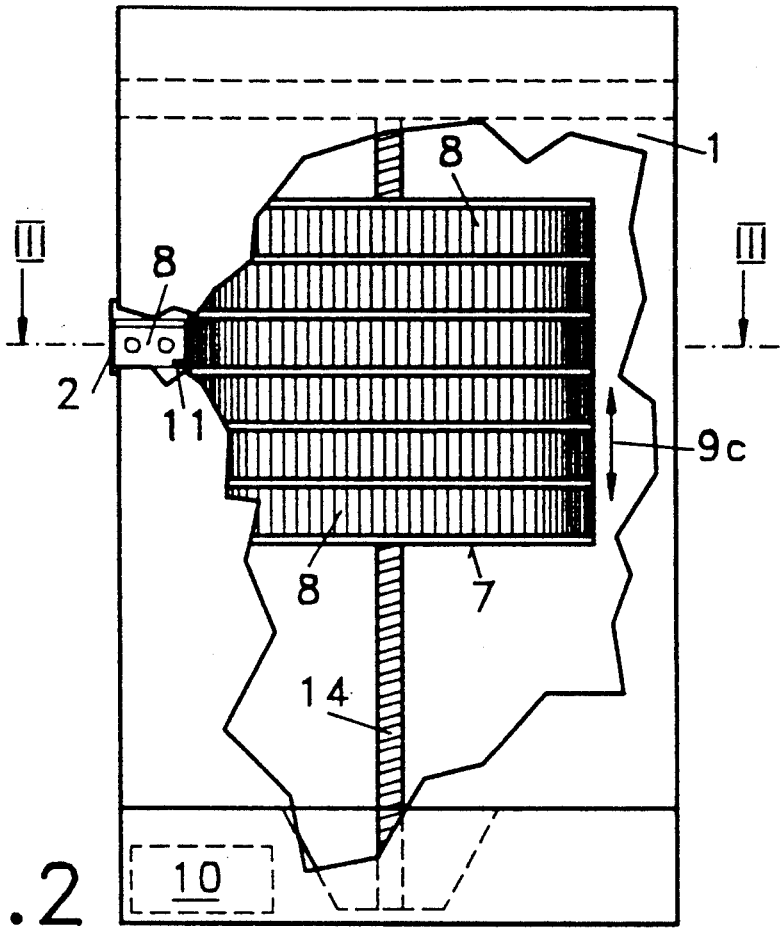
Figure 3:
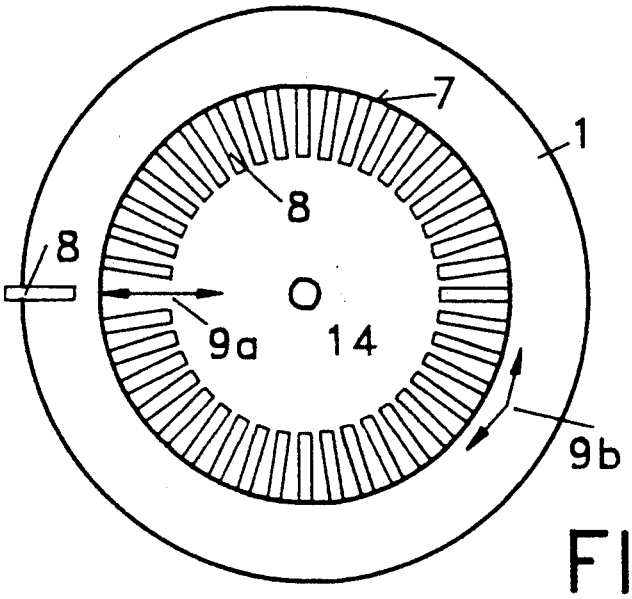
Figure 4:
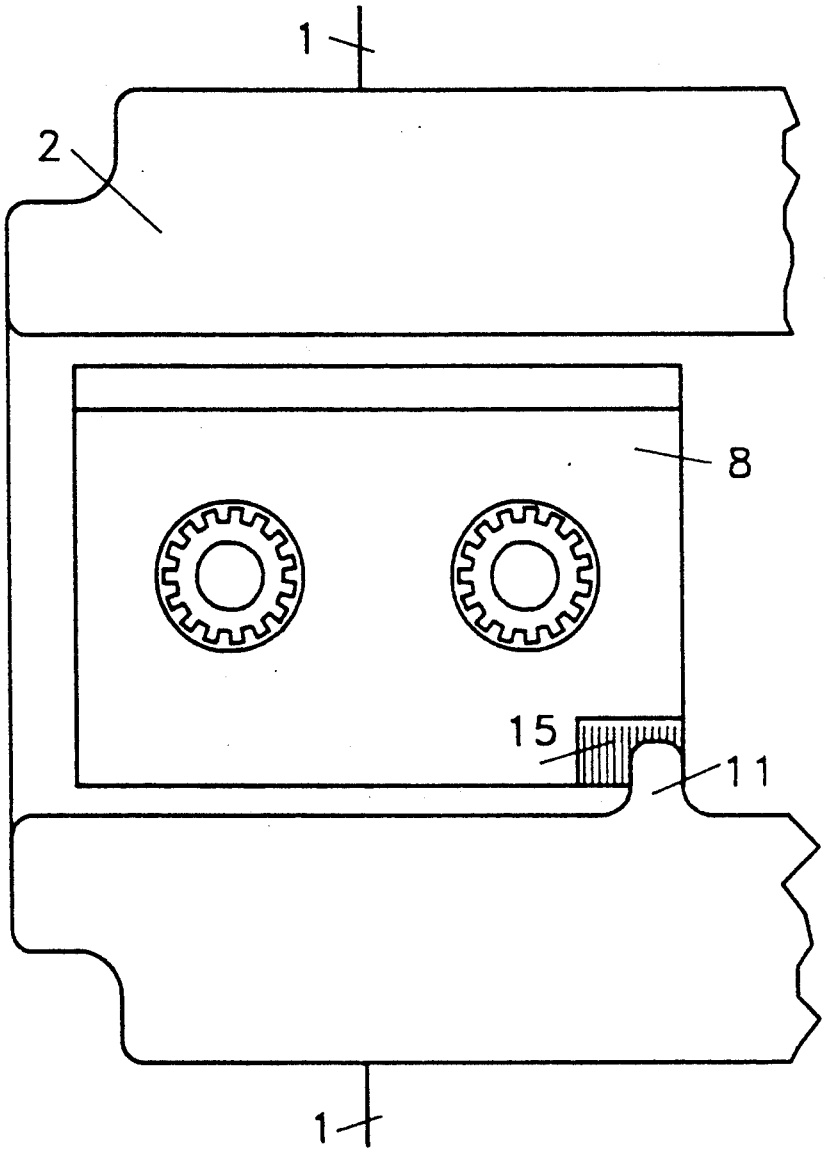
Figure 5:
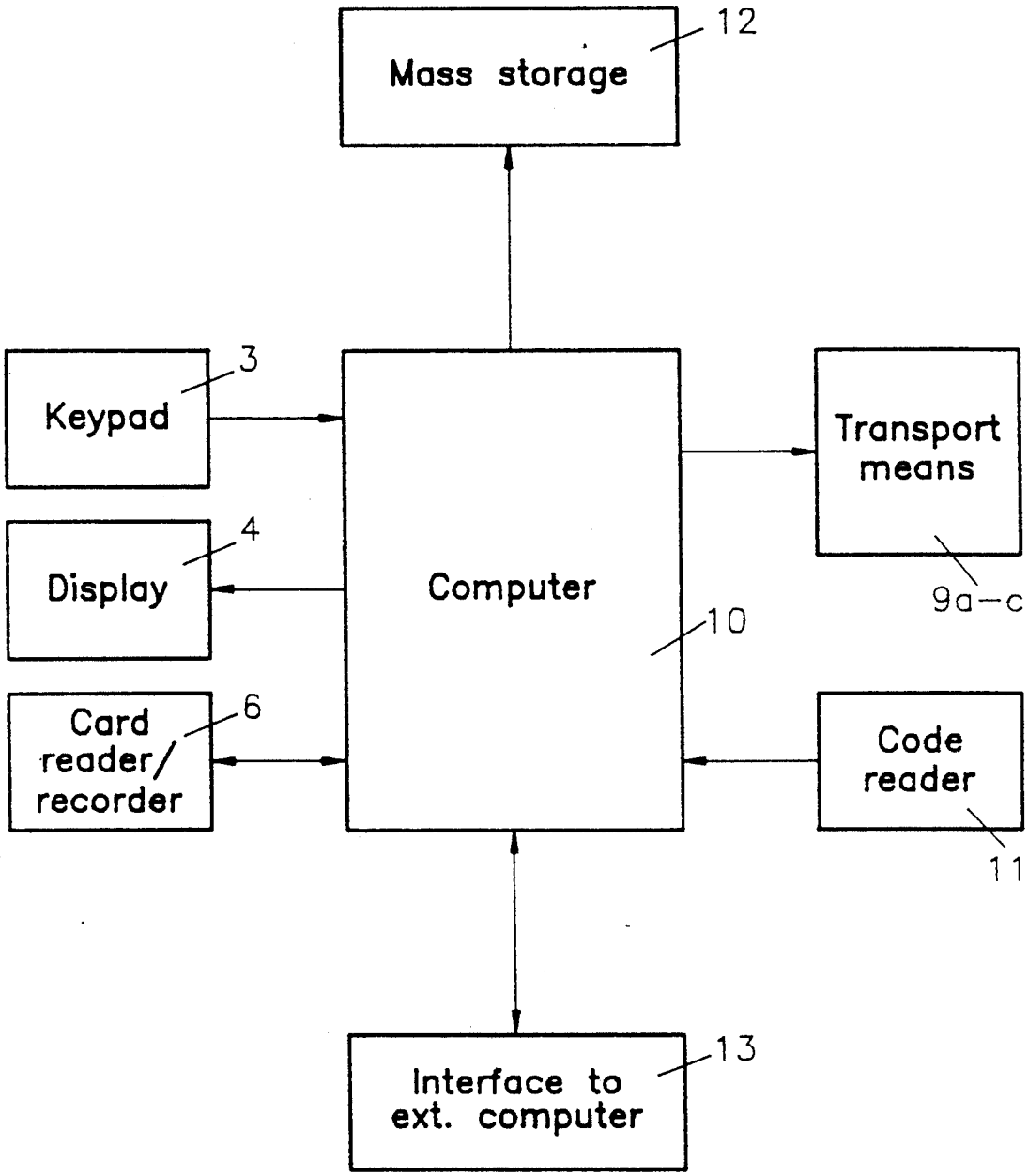
Figure 6:
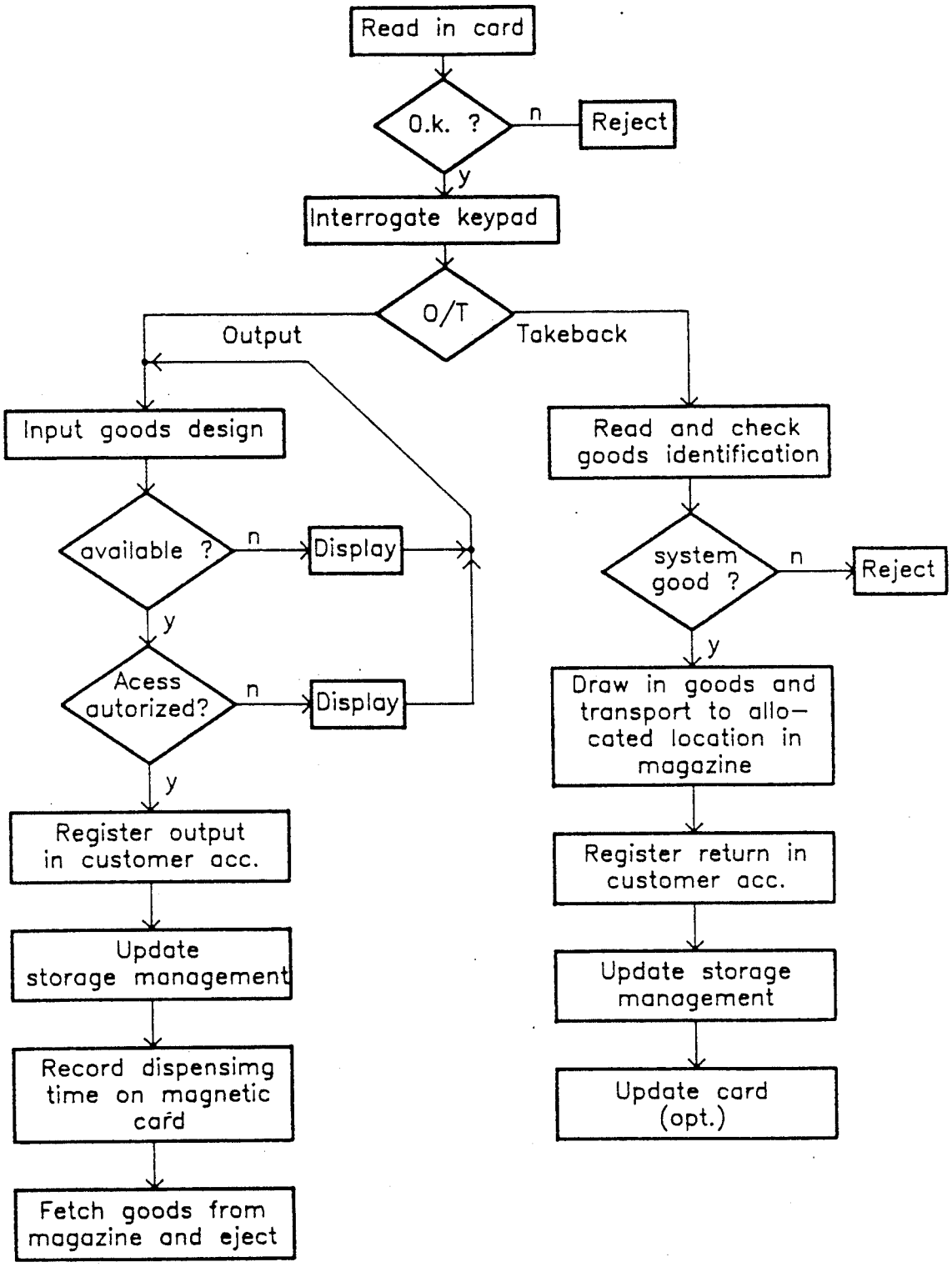
Figure 7:
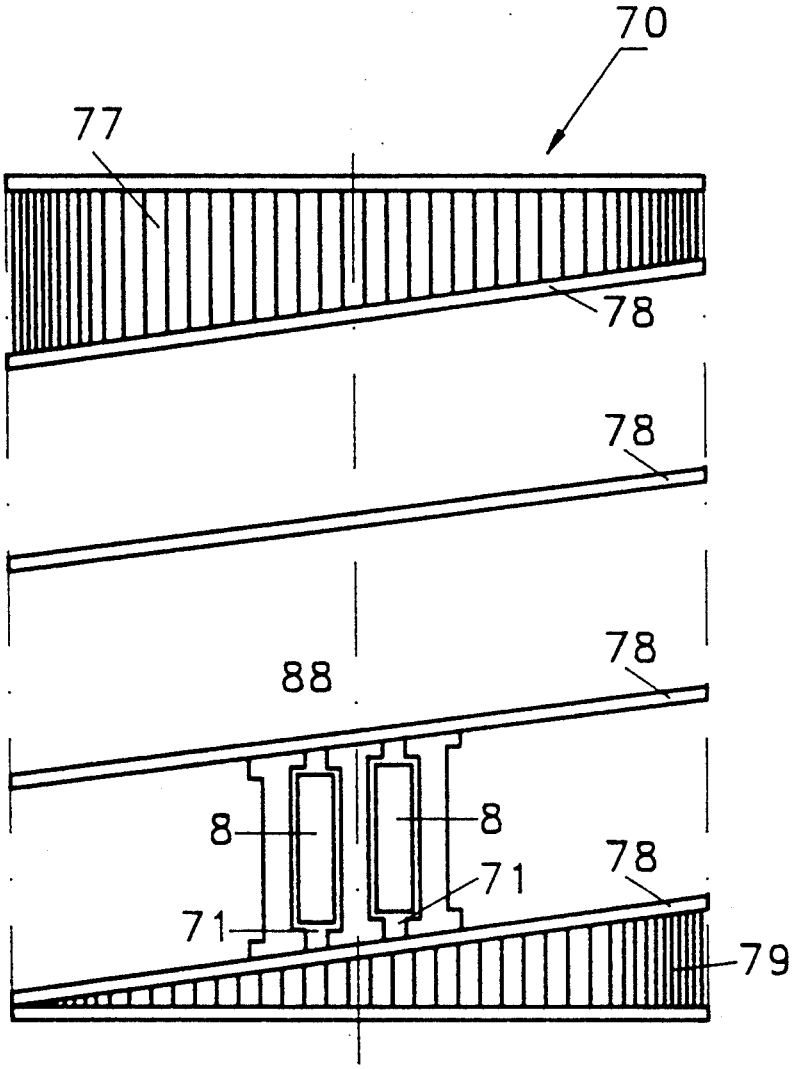
Figure 8:
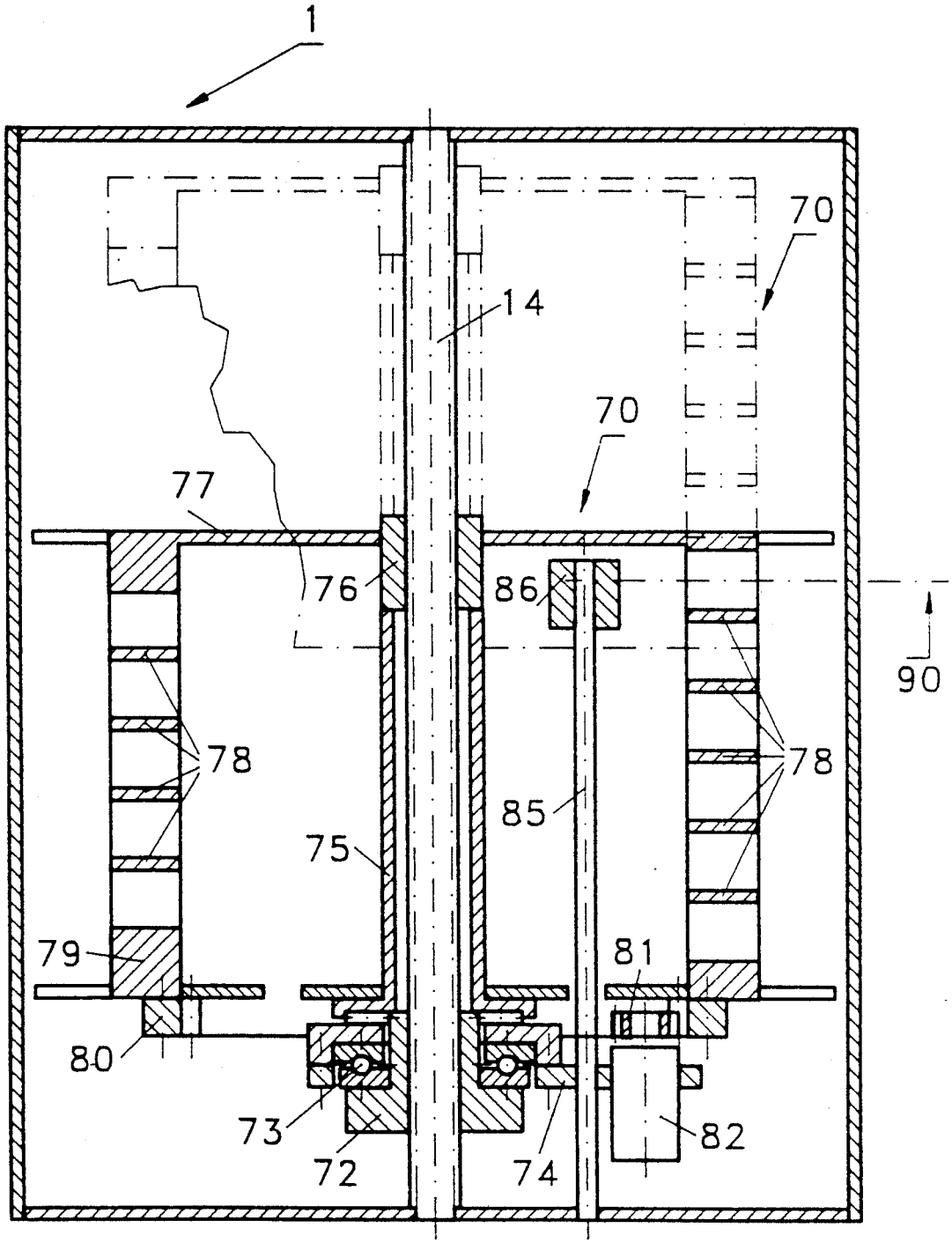
Figure 10:
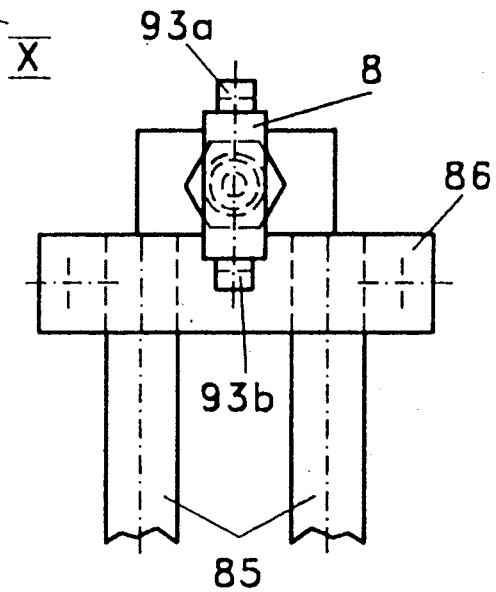
Figure 9:
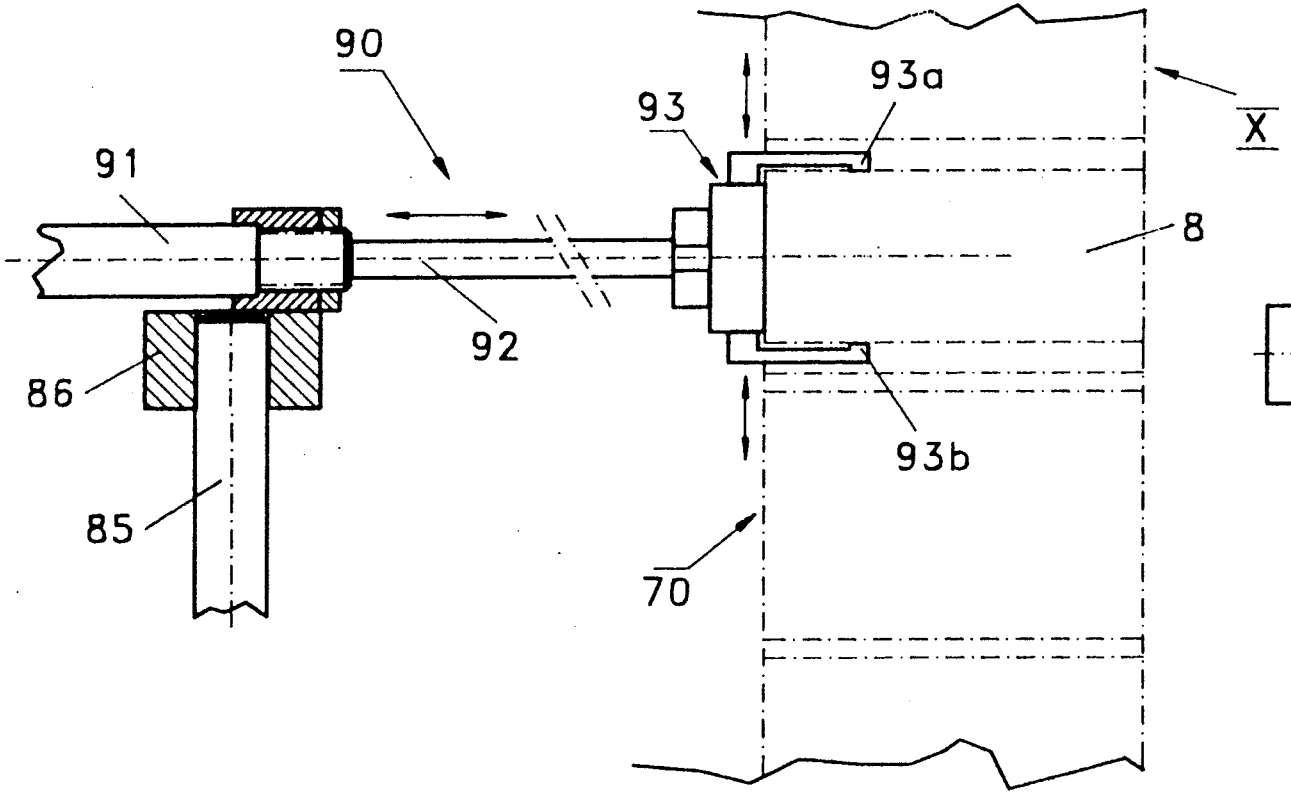
Figure 14:
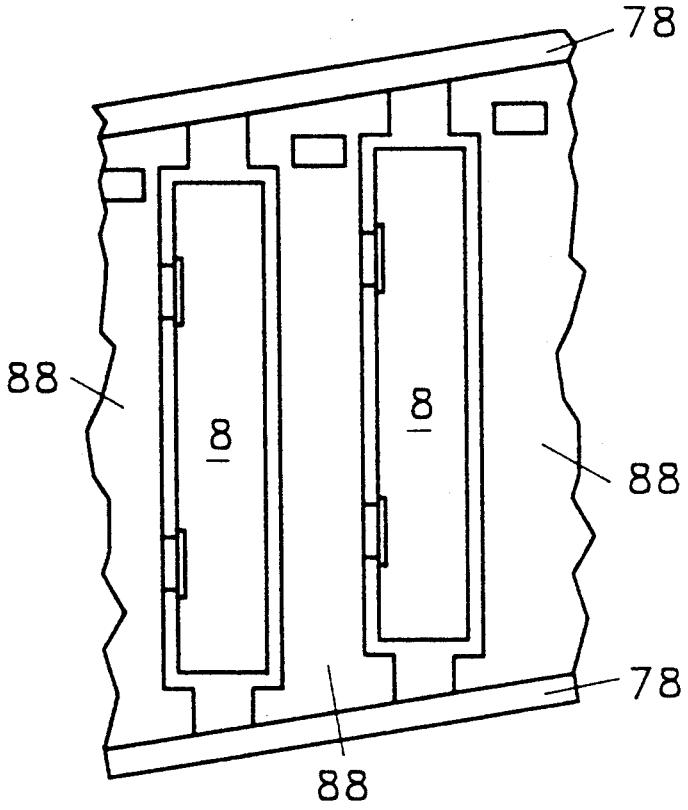
Figures 15, 16:
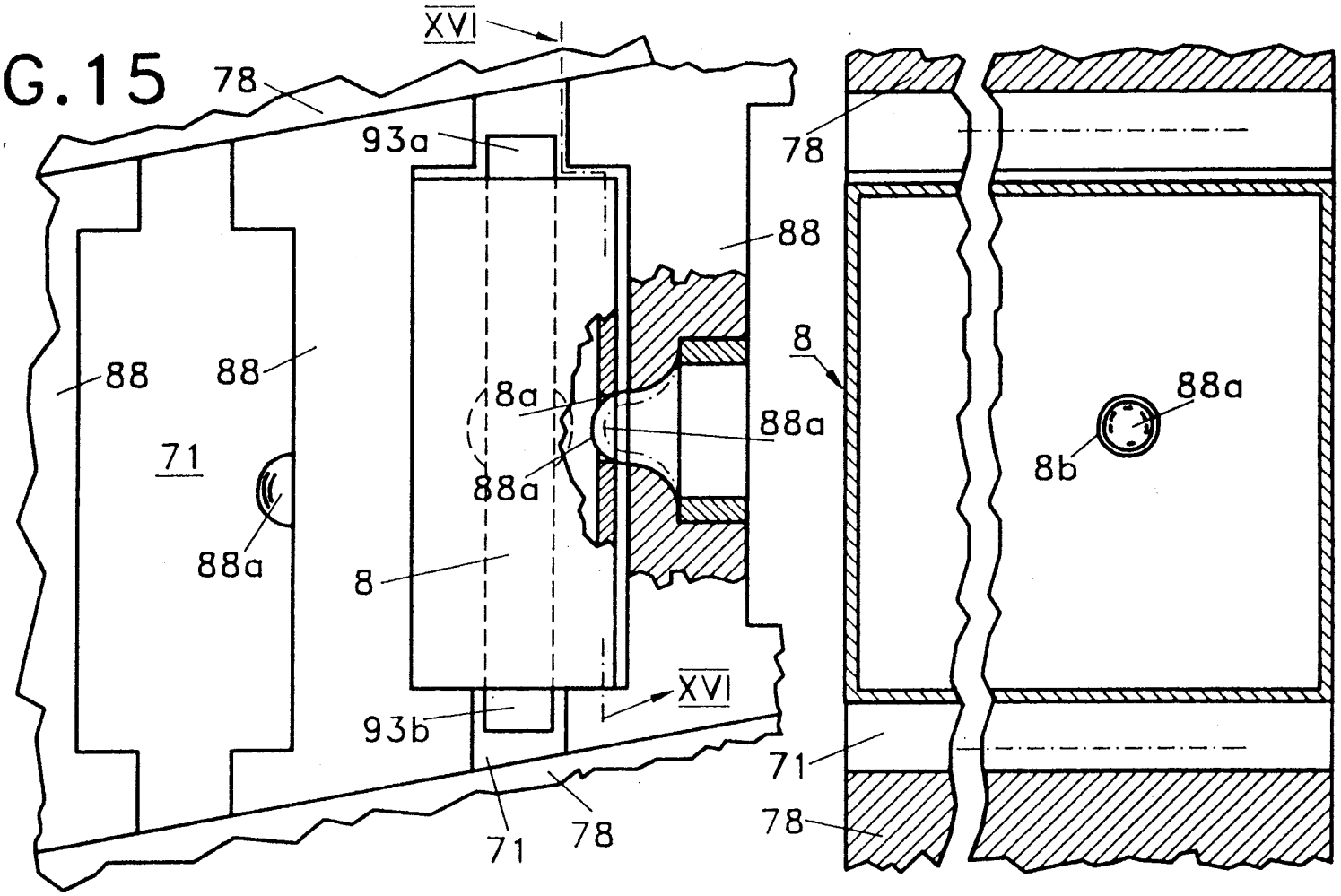
Figure 26:
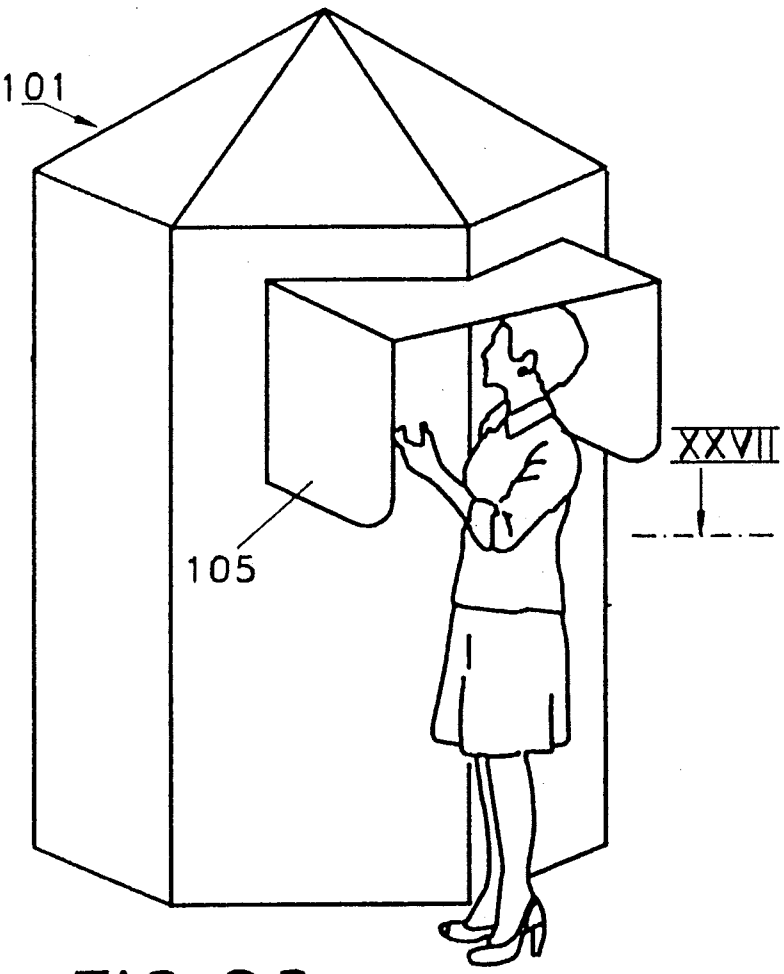
Figure 25:
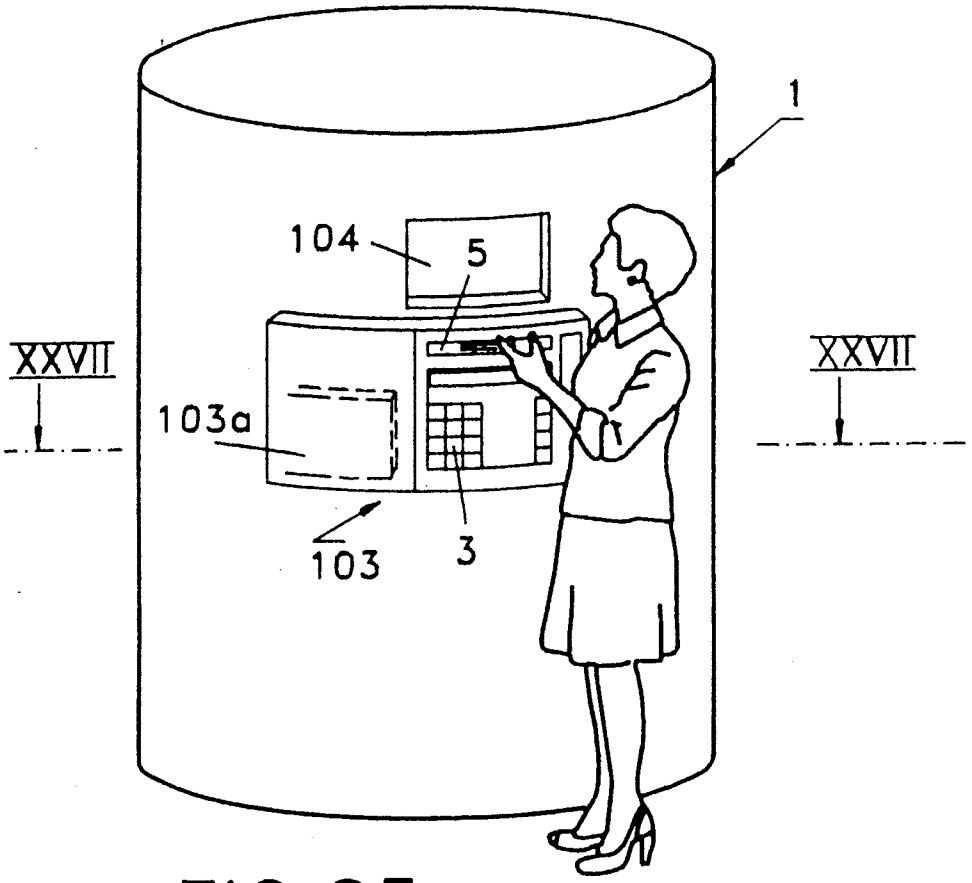
Figure 28:
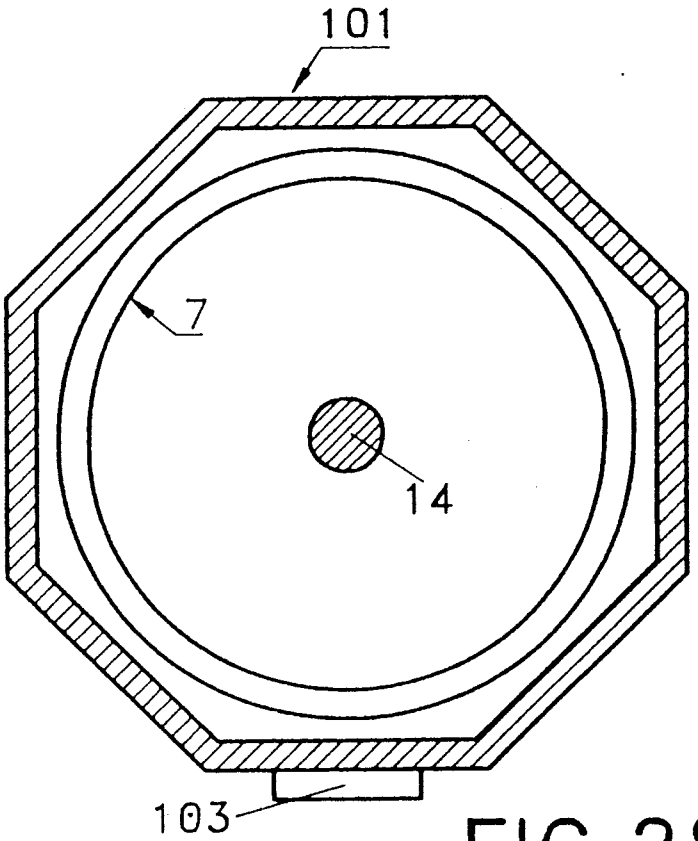
Figure 27:
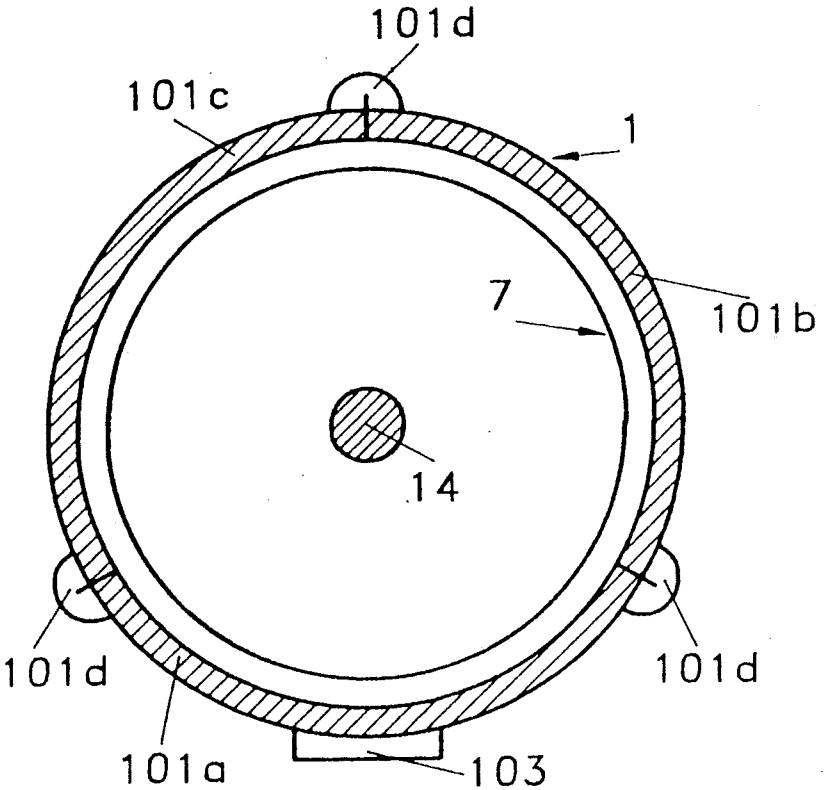
Figure 29:
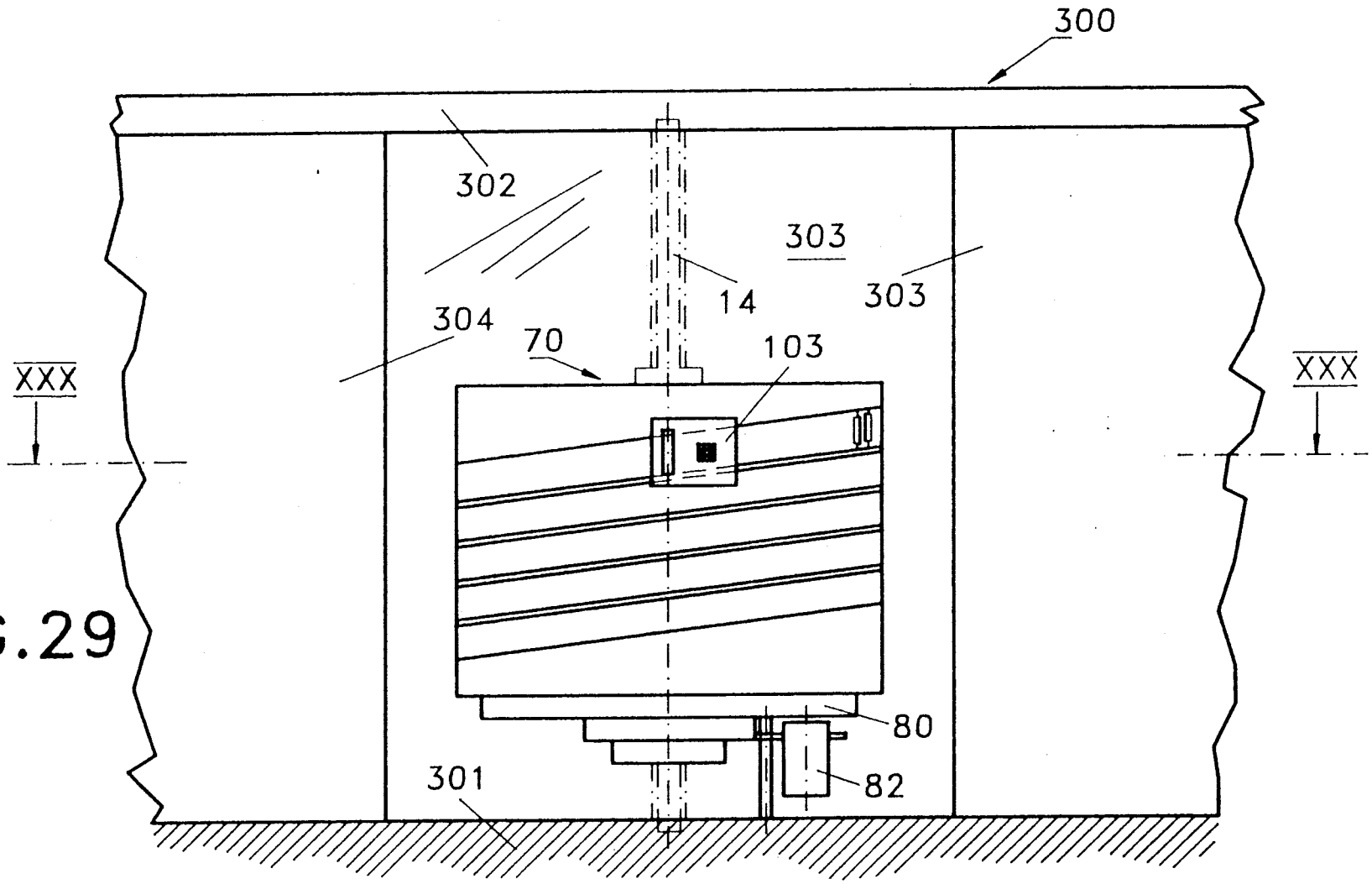
Figure 30:
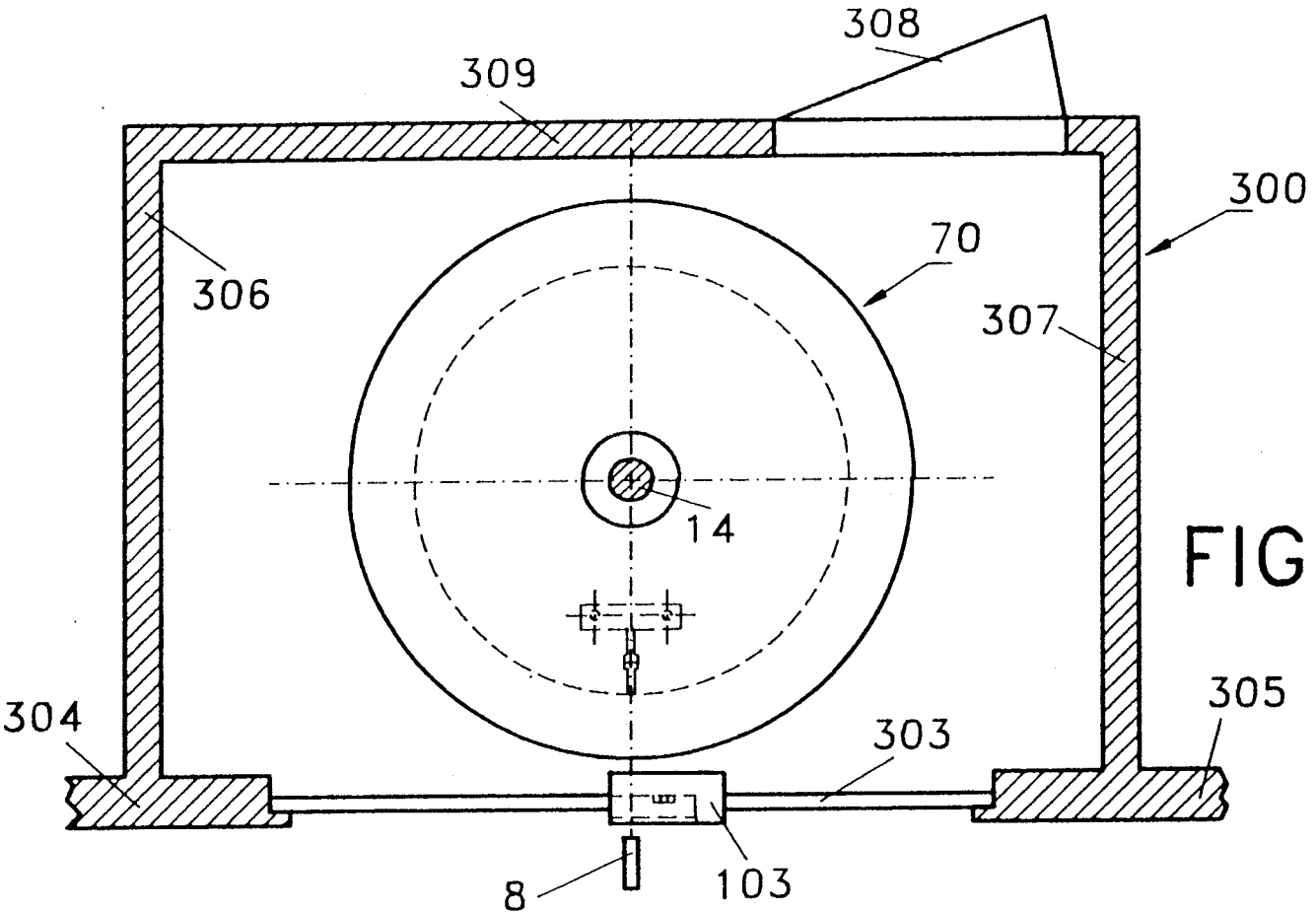
Figure 31:
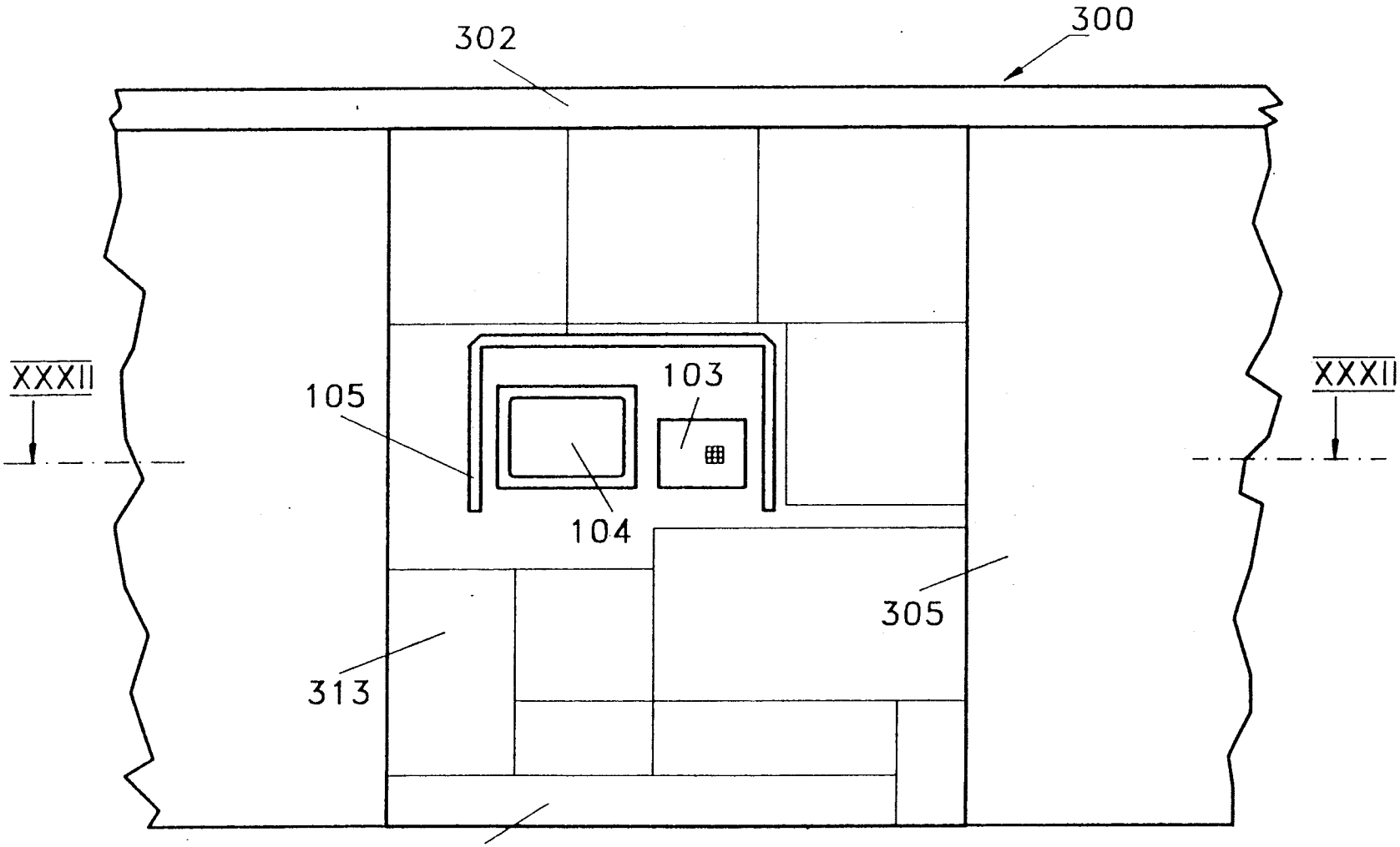
Figure 32:
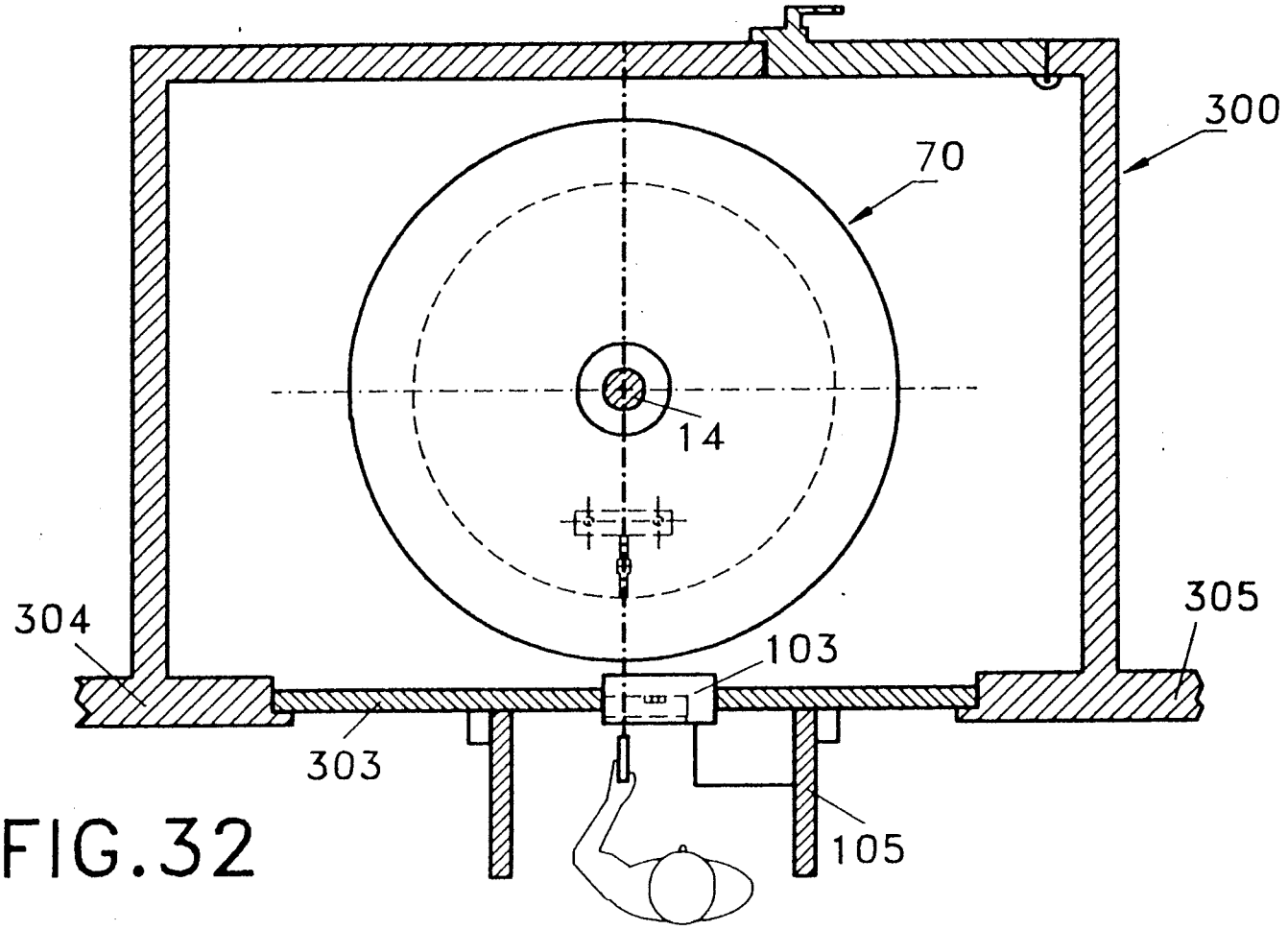
Figure 33:
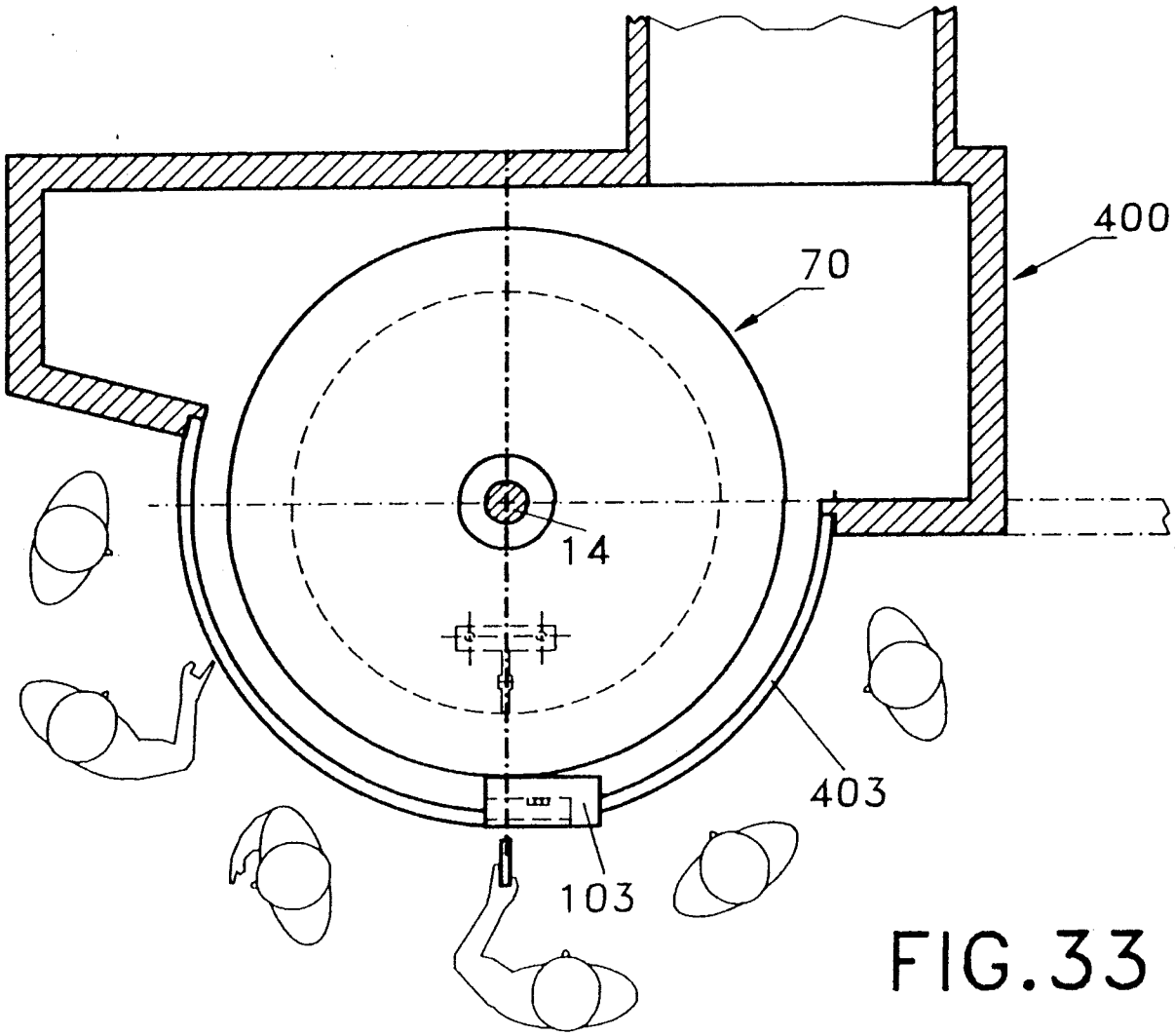
Figure 34:
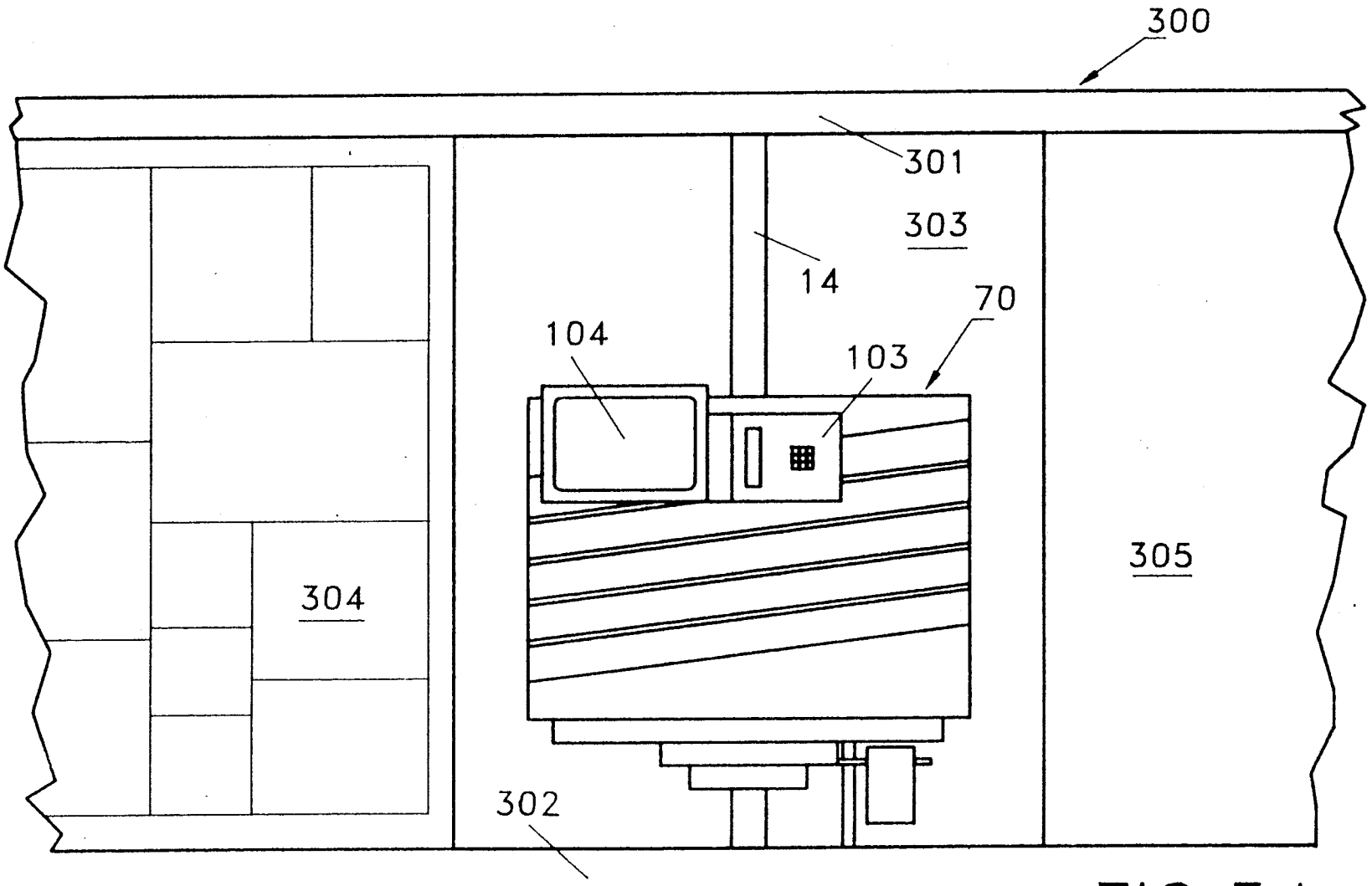
Figure 35:
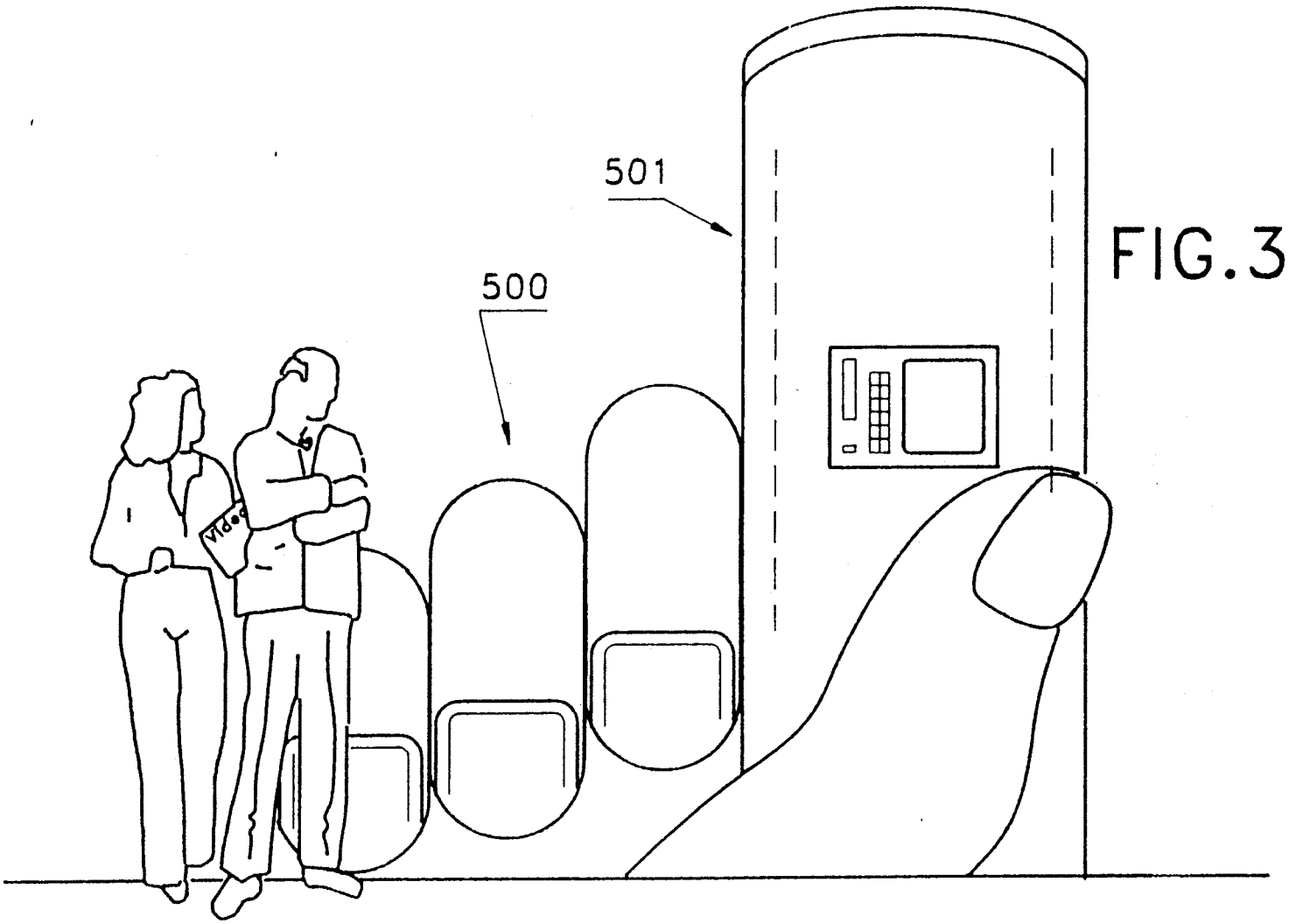
Figure 36:
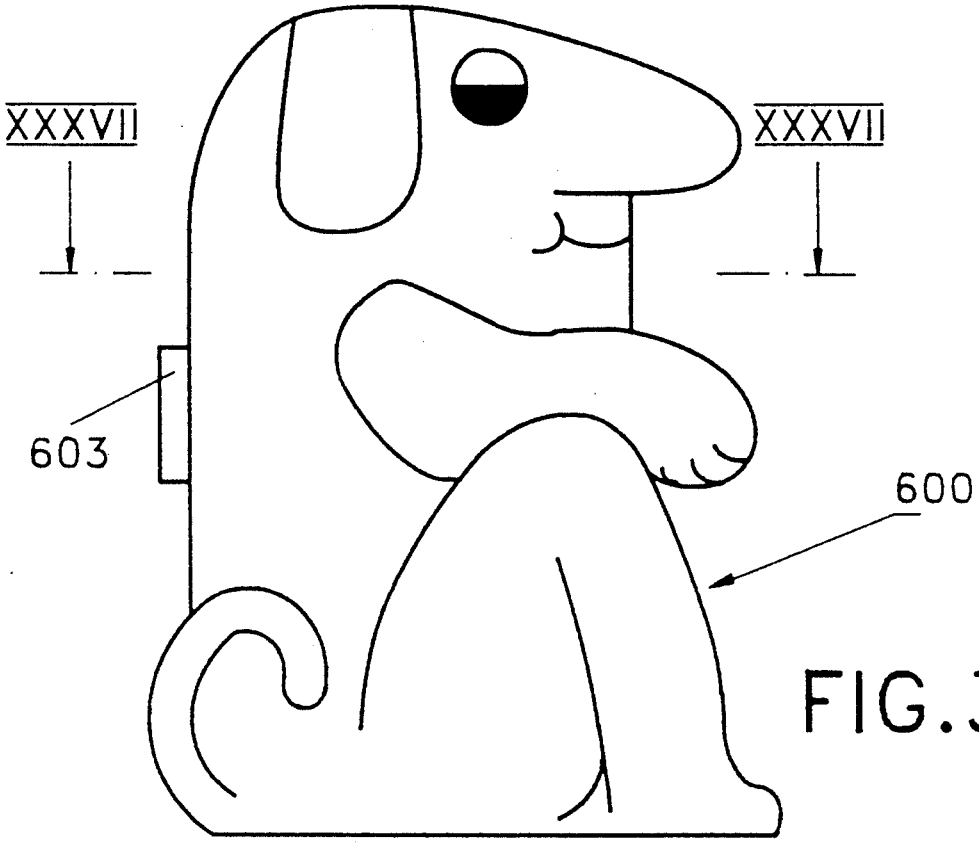
Figure 37:
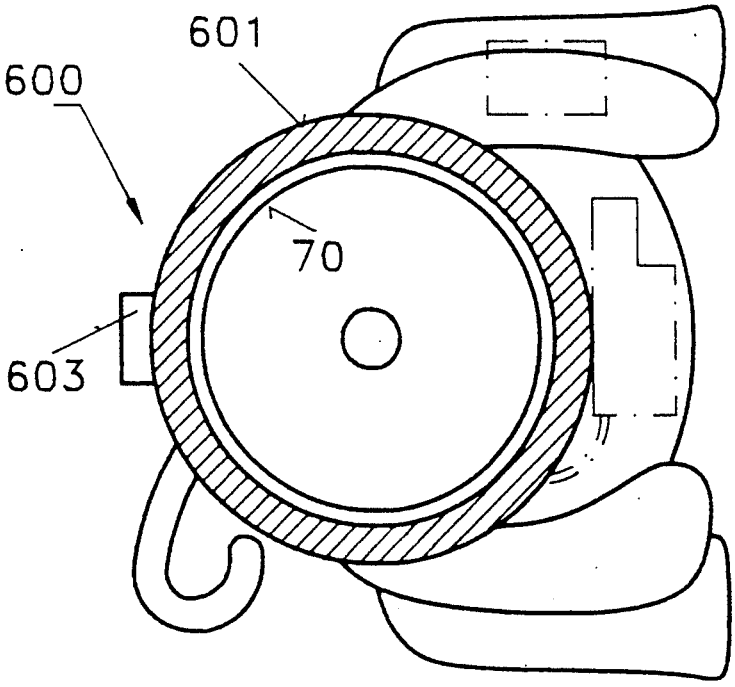
Figure 38:
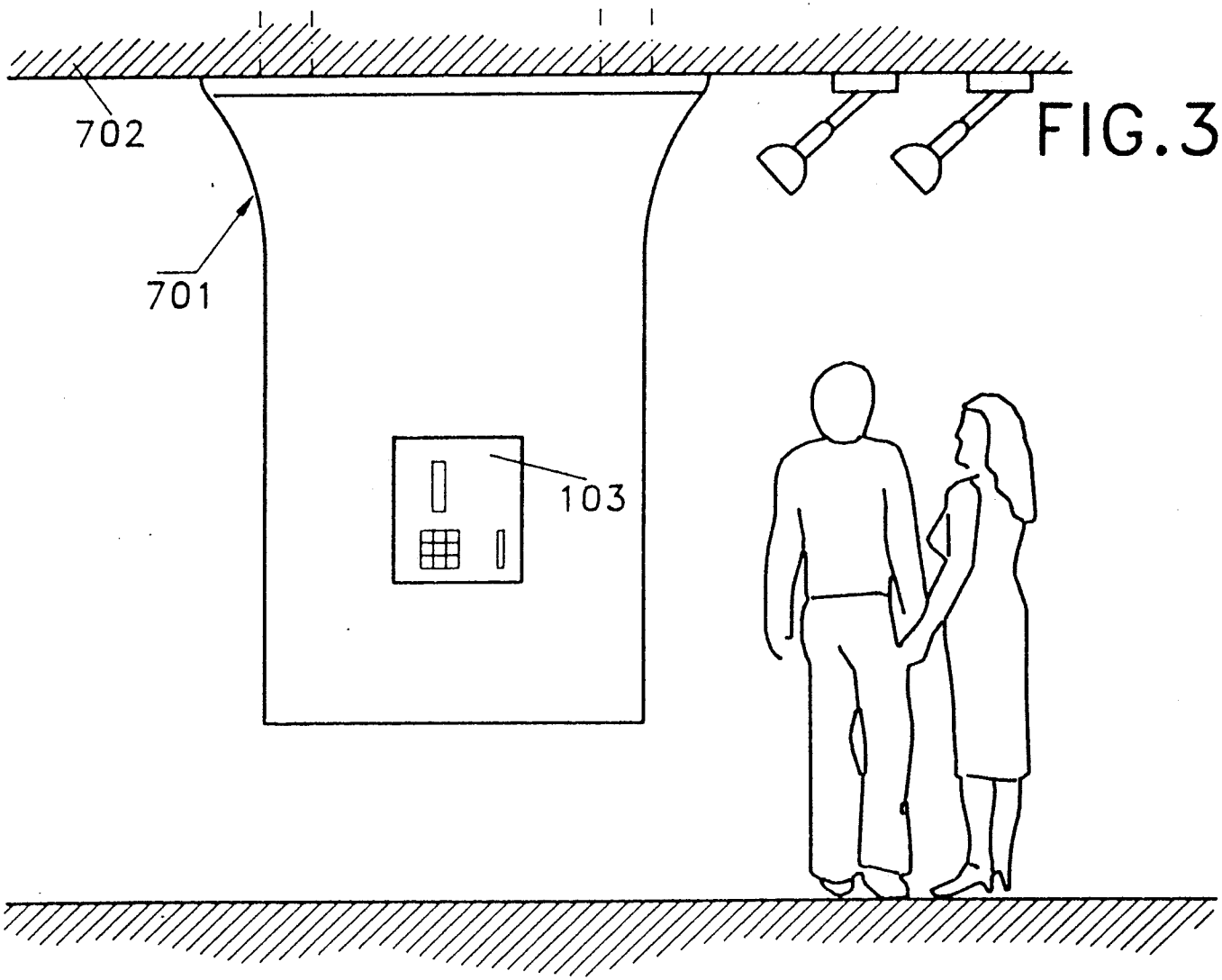
Figure 39:
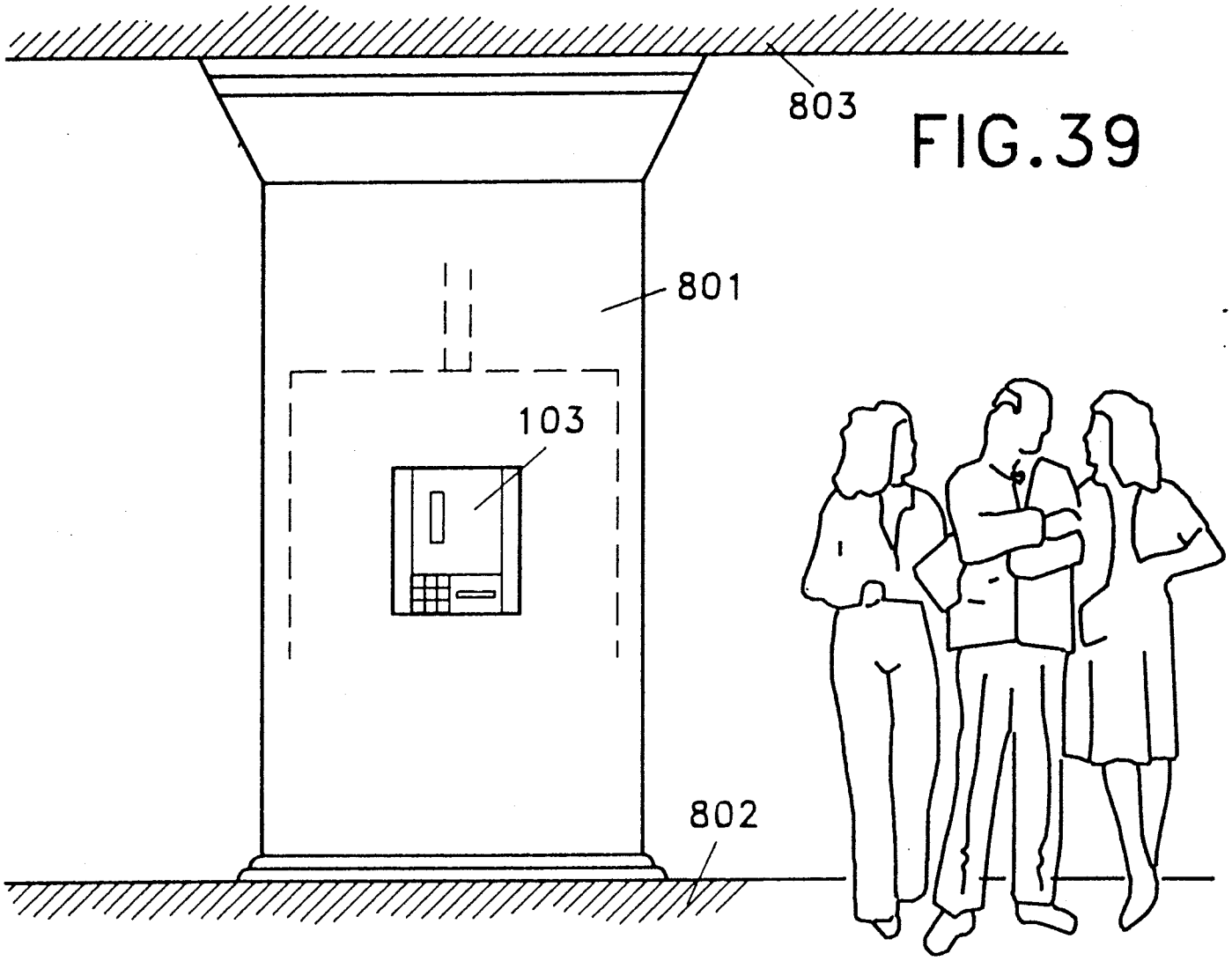
Figure 40:
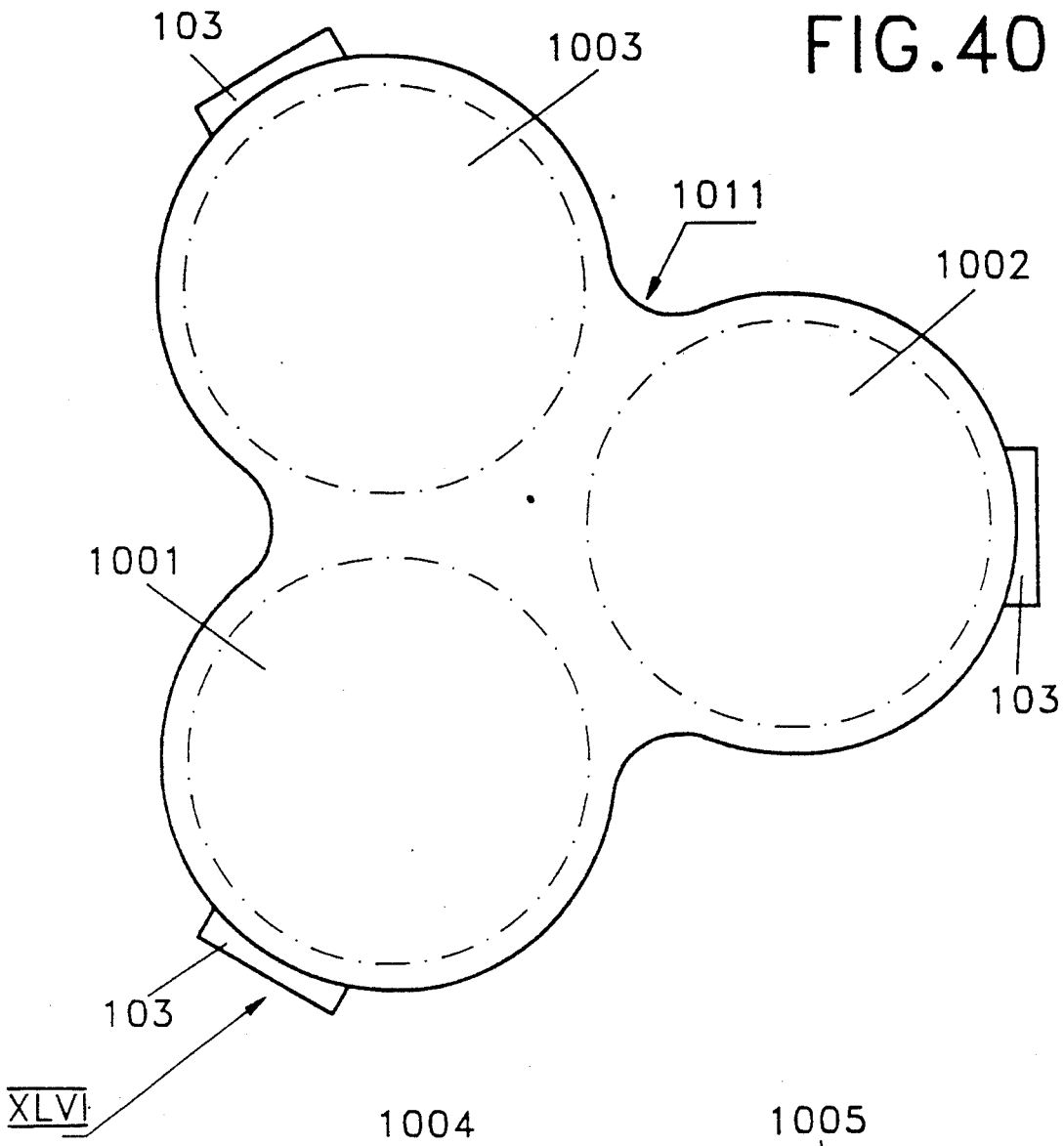
Figure 41:
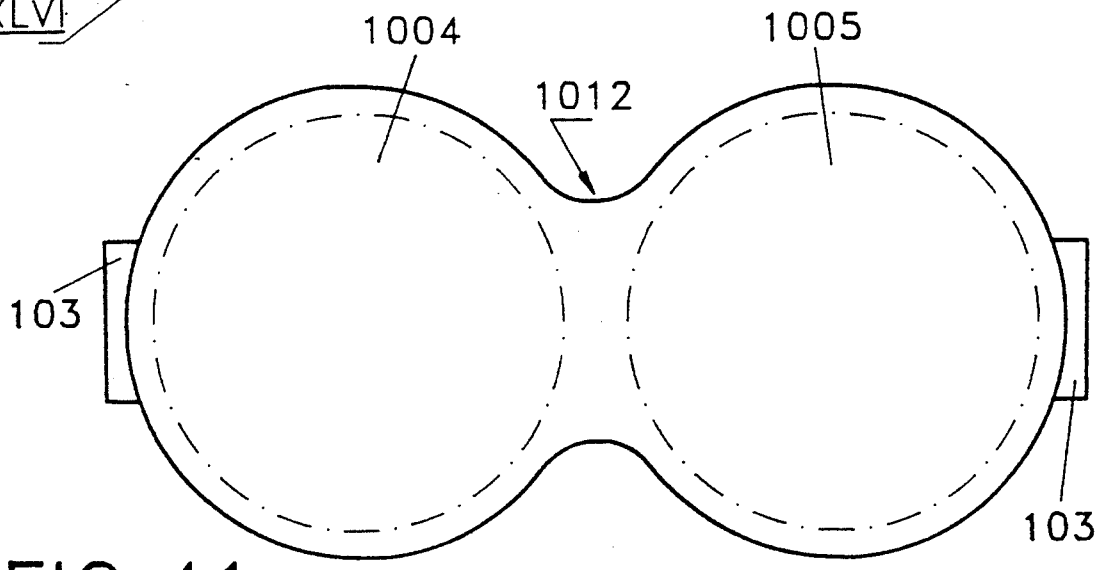
Figure 42:
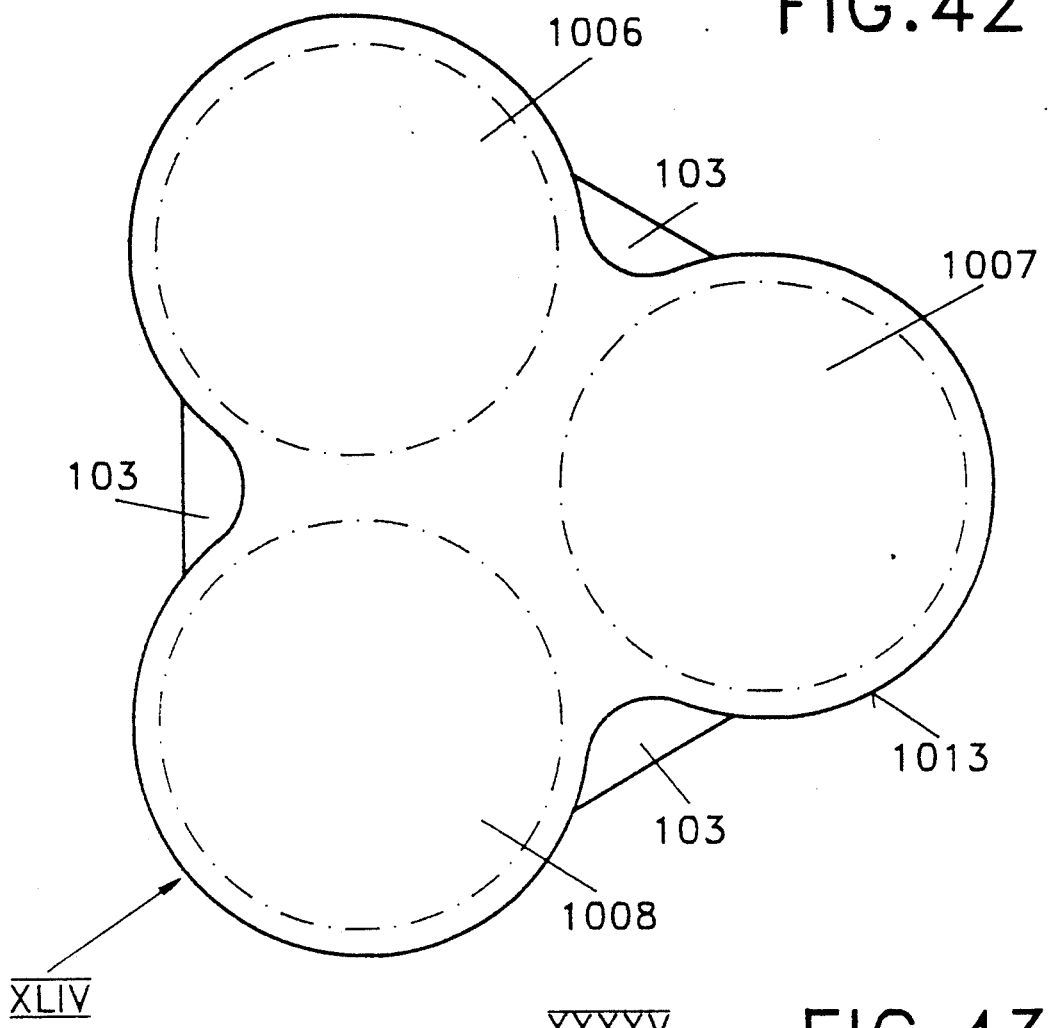
Figure 43:
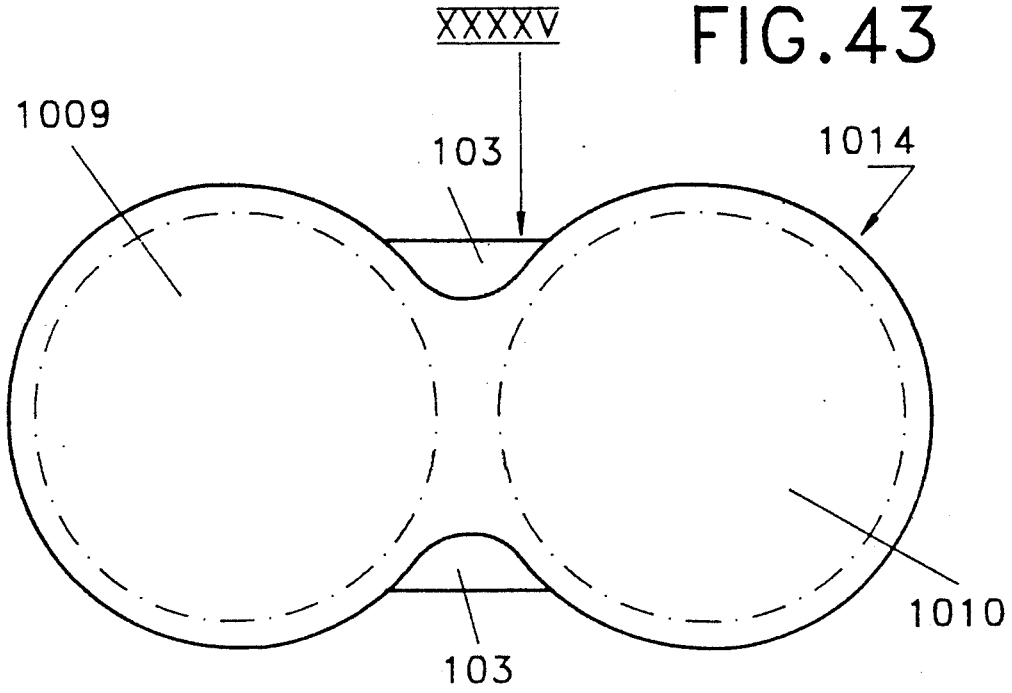
Figure 44:
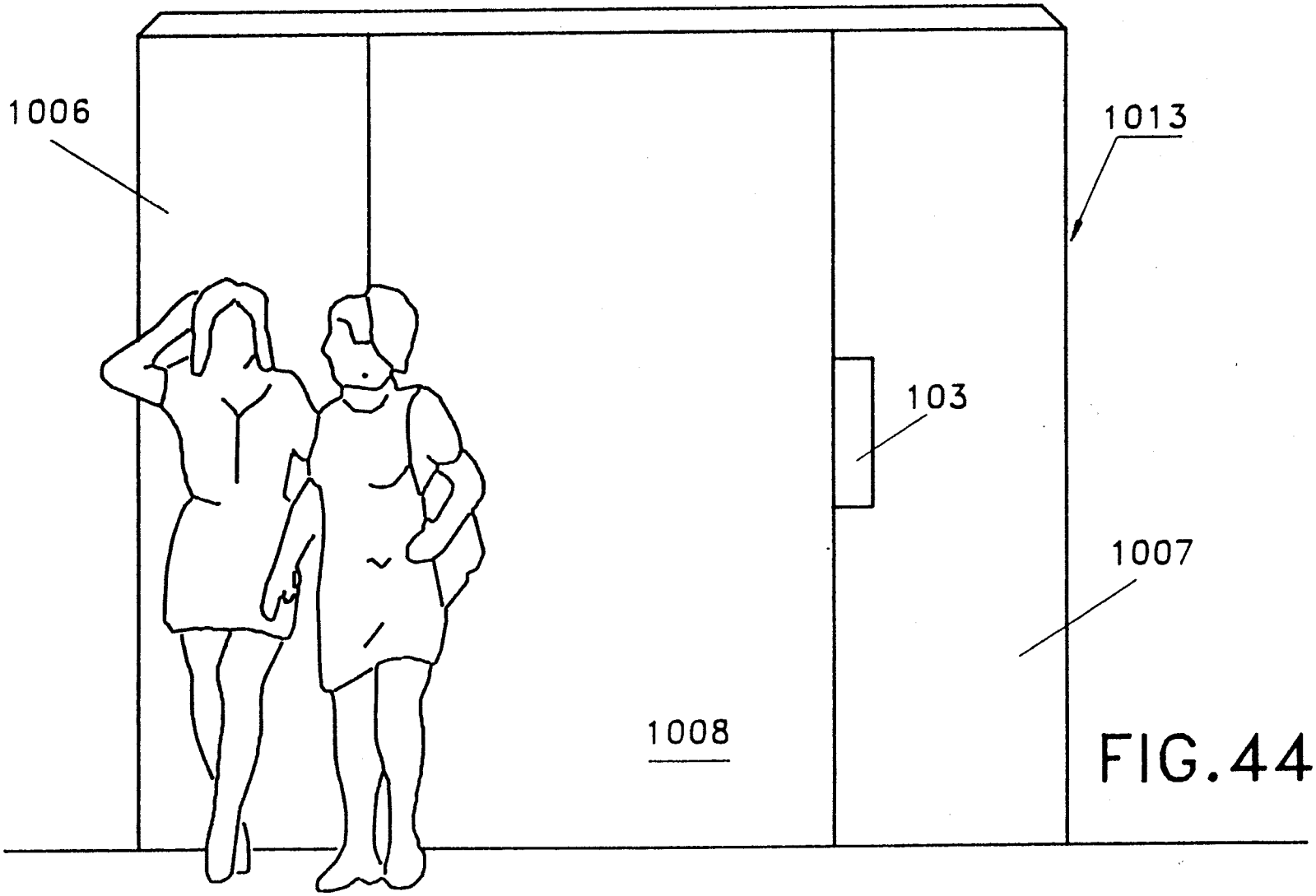
Figure 45:
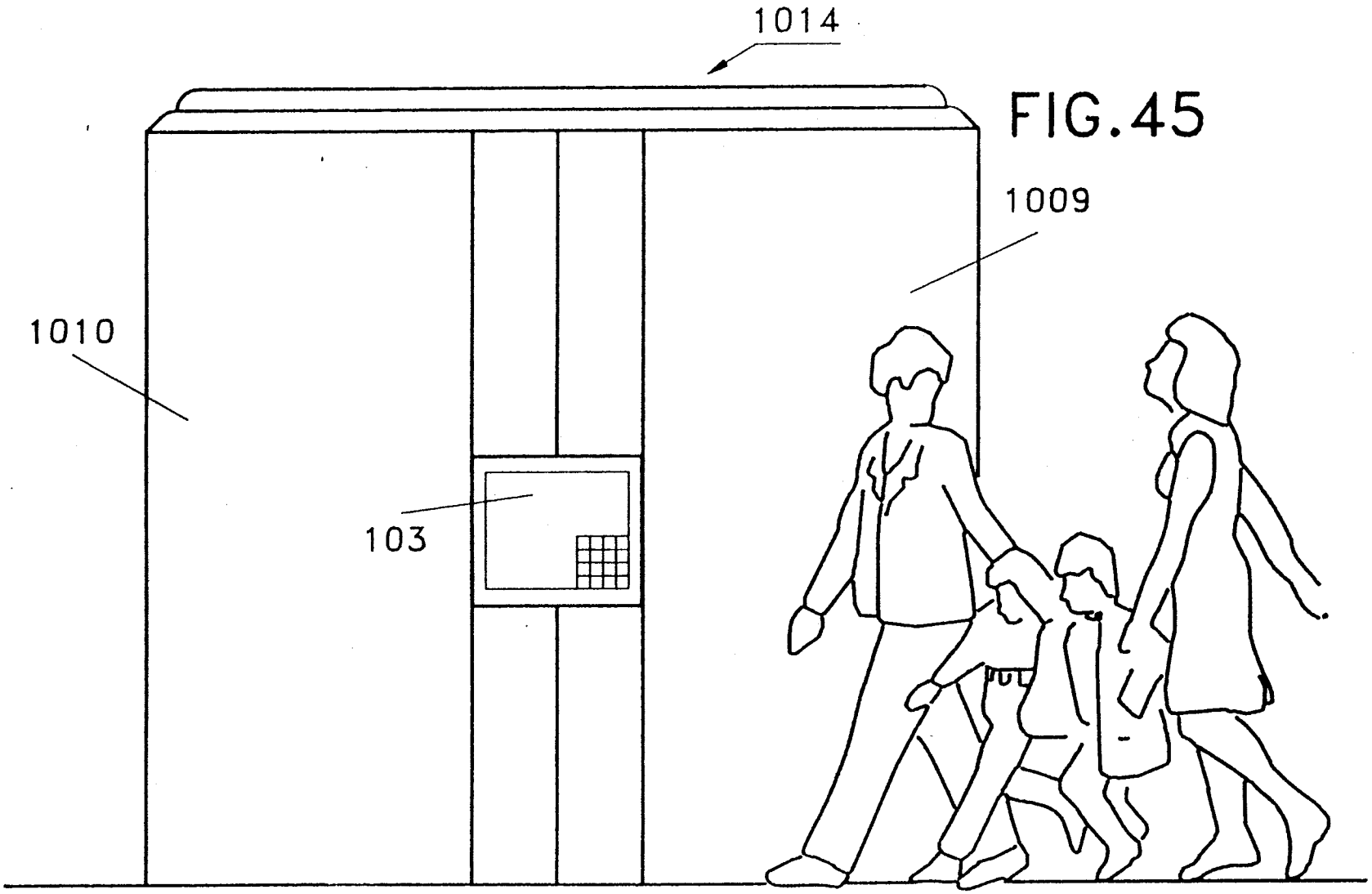
Figure 46:
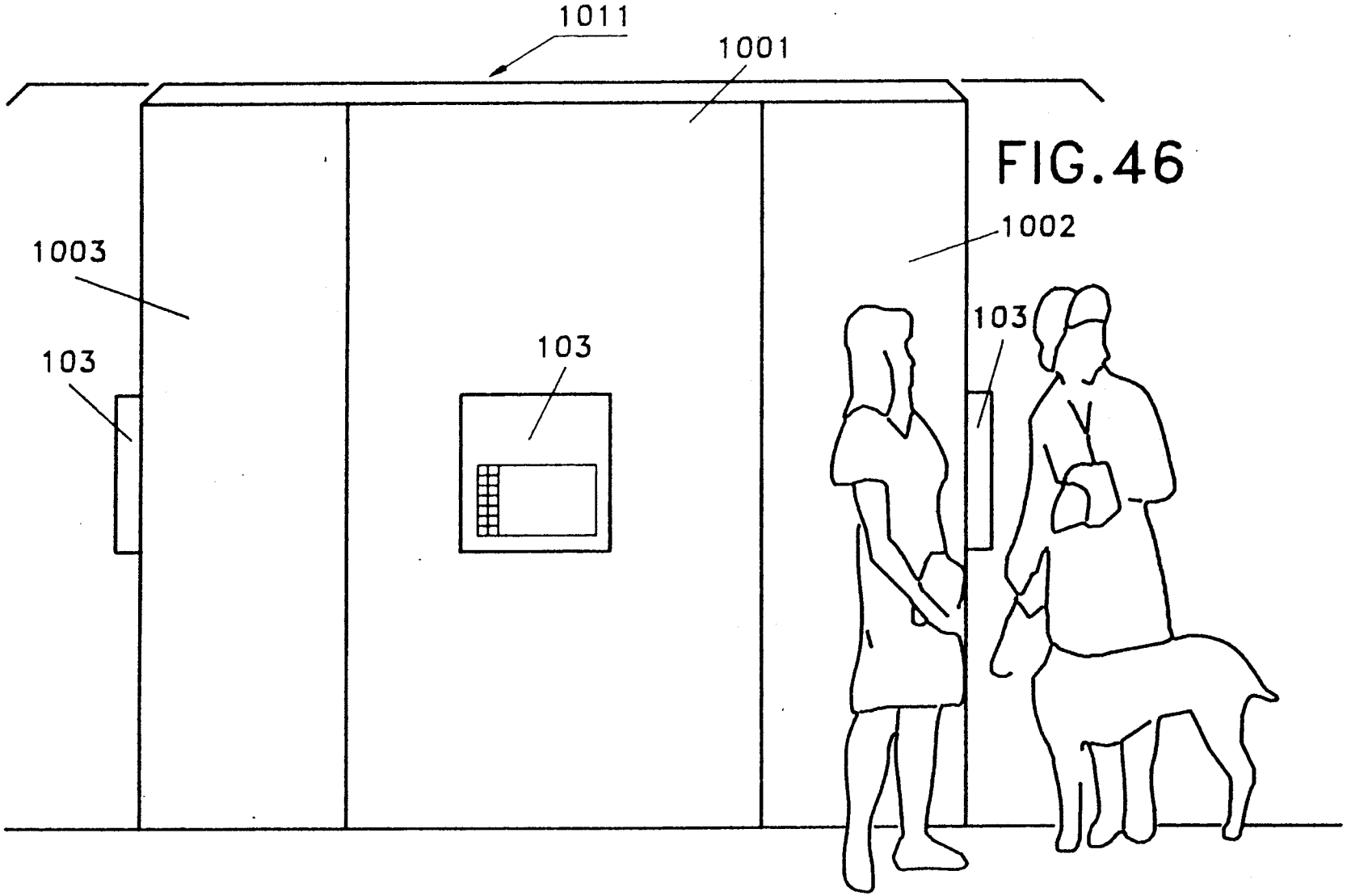

The invention is described in greater detail below with reference to the drawing, in which:

FIG. 1 shows a view of an exemplary embodiment of a device for dispensing goods according to the invention, FIG. 2 shows a view of the device according to FIG. 1 in a partially cut-away representation, FIG. 3 shows a section along the line III—III of FIG. 2, FIG. 4 shows a detail from FIG. 2 in an enlarged representation, FIG. 5 shows a block diagram of the most important electronic parts of the device, FIG. 6 shows a flowchart of the most important function sequences of the device according to FIG. 1, FIG. 7 shows a basic outline of the goods storage magazine of another exemplary embodiment of a device for dispensing goods according to the invention, FIG. 8 shows an axial section through the device of FIG. 7, FIG. 9 shows an enlarged representation of a detail not shown in FIG. 8, partially in section, FIG. 10 shows a view in the direction of arrow X of FIG. 9, FIGS. 11-13 each show a sectional view in the region of the goods chute of the device in three characteristic phases of goods transfer, FIG. 14 shows an enlarged view of a detail from FIG. 7, FIG. 15 shows a basic outline for illustrating the fixing of the goods in the storage magazine, FIG. 16 shows a section along the line XVI—XVI of FIG. 15, FIGS. 17-24 show basic outlines for illustrating diverse variants of embodiments and fastenings of goods holding elements in the storage magazine, FIG. 25 and 26 each show a view of two further exemplary embodiments of the device for dispensing goods according to the invention, FIG. 27 and 28 each show a section along the lines XXVII—XXVII and XXVIII—XXVIII of FIGS. 25 and 26, respectively, FIG. 29 shows a further embodiment variation of the device according to the invention, FIG. 30 shows a horizontal section along the line XXX—XXX of FIG. 29, FIG. 31 shows a further embodiment variation, FIG. 32 shows an associated horizontal section along the line XXXII—XXXII of FIG. 31, FIG. 33 shows a further embodiment variation in the horizontal section analogous to FIG. 32, FIG. 34 shows a view of a further embodiment variation, FIG. 35 shows an exemplary embodiment of a device for dispensing goods according to the invention integrated in a figure of a hand, FIG. 36 shows another exemplary embodiment integrated in a seated animal, FIG. 37 shows a section along the line XXXVII—XXXVII of FIG. 36, FIG. 38 shows a further exemplary embodiment in the form of a suspended column, FIG. 39 shows a further exemplary embodiment in the form of a column connecting the ceiling and floor of a room, FIG. 40 and 41 each show a horizontal section through a triple and a double device for dispensing goods according to the invention, FIG. 42 and 43 each show a horizontal section through a slightly modified form of the devices of FIGS. 40 and 41, FIG. 44 shows a view of the device for dispensing goods in the direction of arrow XLIV of FIG. 42, FIG. 45 shows a view in the direction of arrow XLV of FIG. 43, and FIG. 46 shows a view in the direction of arrow XLVI of FIG. 40.

In accordance with FIG. 1, the device for dispensing goods has the external form of an advertisement pillar (advertising column). Accordingly, it comprises an essentially column-shaped or cylindrical housing 1 which accommodates all parts of the device. Arranged in the housing wall is a goods chute 2, through which goods can be removed from the device and deposited in it. An operating panel comprising a keypad 3 and an optical display 4 and which is likewise arranged in the housing wall in the vicinity of the goods chute 2 serves for communicating with an electronic control device 10 located in the interior of the housing in order to activate the desired function. Furthermore, an insertion slot 5 is provided for a magnetic card reader and recorder 6 arranged immediately behind it.

In addition to the parts already mentioned, located in the interior of the housing 1 are essentially a storage magazine 7 for goods 8 to be dispensed and to be taken back, for example videocassettes, electromechanical transport means (symbolized by the arrows 9*a*, 9*b* and 9*c*) for conveying the goods in both directions between the storage magazine 7 and the goods chute 2, as well as a computer 10 with diverse peripheral units interacting with it, which includes mass storage 12 in the form of a magnetic tape recording device or punched tape recording device and an interface 13 to an external computer as well as a code reader 11 arranged in the goods chute 2 (FIG. 5). The keypad 3, the optical display 4 and the magnetic card reader/recorder 6 are likewise connected to the computer 10 and co-operate with the same.

The goods storage magazine 7 is preferably designed as a carousel having several levels which can rotate about an axial spindle 14 (arrow 9*b*) and which can also be displaced along this spindle (arrow 9*c*). The drive means necessary for this are conventional and thus do not require any special explanation. The only essential point is that the carousel is controlled by the computer 10 and can be moved in such a way that defined access is possible to each individual storage cell. Likewise arbitrary transport means, which are known per se and hence are indicated here symbolically only by arrow 9*a*, and which are likewise controlled by the computer 10, are responsible for transporting the goods from the storage cells selected in each case to the goods chute 2, or vice versa from the latter back into the respective storage cells in the storage magazine 7.

In accordance with an advantageous embodiment of the invention, all goods 8 are provided with a data carrier 15 which is preferably captively attached to the goods. The data carrier 15 preferably contains identification information which identifies the goods as belonging to the system, as well as position information indicating the storage position of the goods in the storage magazine 7. Moreover, the data carrier 15 can also contain further goods-related information, for example title and so forth in the case of videocassettes. The data carrier 15 contains the information in the form of a bar-code, a hologram or magnetic strip, for example. The code reader 11 arranged in the goods chute 2 is designed accordingly (FIG. 4).

The mode of operation of the device according to the invention is described below with reference to FIG. 6. All functions run under the control of the computer 10, which is correspondingly programmed.

Each user of the device is equipped with an individual magnetic card which contains individual user identification data as well as storage space for recording data relating to the transactions made.

First of all, the user inserts his magnetic card into the slot 5 of the card reader/recorder 6, whereupon the card is first read and its validity checked, and if the result of the test is negative, the card is rejected, or otherwise any suitable reaction is triggered, here generally referred to as "reject". Alternatively, or additionally, the user can be requested to enter a personal identification number (PIN). If this corresponds to the number stored on the card or in the system, the system is enabled, otherwise "reject" occurs again.

Following this, the user has to specify, by pressing appropriate keys on the input keypad 3, whether he wishes to remove goods (buy borrow) or return goods. The program then branches accordingly.

In the case of a goods removal operation, first of all the designation of the desired goods, e.g. the title of the videocassette, is entered in plain text or in the form of a number or the like. It is then checked whether the respective goods are in stock at all, and if this result is negative the user is notified of this via the display 4, whereupon he can, for example, select other goods. Subsequently, on the basis of the user identification information read in from the magnetic card, it is checked whether the user is authorized to receive these goods (e.g. minimum age for certain categories of films). If this result is negative, this is correspondingly indicated. Otherwise, the dispensing of the goods is registered in a customer accounting system programmed in the computer (user, goods, date, time) and the movement of goods is recorded in a likewise programmed storage management system. Furthermore, in accordance with a preferred embodiment of the invention, the type of goods and the dispensing time (date, if necessary time) is recorded on the magnetic card of the user. The selected goods are then fetched from the storage magazine and forwarded to the goods chute, from where the user can remove them.

In the case of returning goods, first of all the identification information is read off from the data carrier of the goods and checked. If the result is negative, e.g. if non-system goods are present, an appropriate reject reaction takes place. Otherwise, the goods are drawn in and transported to their allocated location in the storage magazine on the basis of the position information likewise read off from the data carrier. The return of the goods is then accordingly registered in the customer accounting system and in the storage management system, and if necessary also recorded on the magnetic card.

By virtue of the fact that the dispensing time of the goods is recorded on the magnetic card of the user, goods can also be returned at a different device than the one where the goods were taken out. It is after all possible for the corresponding information to be read off from the magnetic card when the goods are returned and be used for the customer accounting.

In accordance with the above explanations, the device for dispensing goods according to the invention is thus provided with an identification device for recognizing and checking identification information attached to the goods, this device being realized by the code reader and the correspondingly programmed computer. Additionally present is, realized solely as a program, a storage management system and a customer accounting system, it being possible for these to be designed to be more or less powerful and user-friendly depending on the requirement. Finally, an access control and registration system is also provided in the form of the card reader/recorder and a corresponding computer program part, which preferably selectively controls the access to various goods or groups of goods in a user-specific manner.

The above-described mode of operation of the device according to the invention is to be understood purely as an example. It is of course possible for the organization of the sequences and the diverse functions to be varied in numerous ways and adapted to the individual requirements.

It is thus, for example, possible to register relevant customer accounting data in each case either immediately or at regular intervals on the mass storage. This can then be removed, for example once a month, and sent to an external computer for automatic invoicing. Alternatively, the computer of the device could also be coupled on-line to an external computer, or it is is also possible for the invoicing to be carried out directly in the device itself. In the case of non-payment, the magnetic card in question can be barred by means of the software, for example.

It is of course possible for the device to be designed in such a way that it also accepts credit or debit cards, similar to the known phone card, and automatically carry out the required transactions. For example, for these purposes the Universal Card Terminal marketed by the Olivetti Systems & Networks (OSN) company in Switzerland can be (also) used, or the device correspondingly designed (see Olivetti brochure, code 8905.D.5000 EFT).

Existing software can be used for realizing or implementing the functions described. Particularly expedient is, for example, the software package marketed under the name of "Europa 3000" by Rotron Software AG, Sales and Systems Support, CH-5013 Niedergösgen, Switzerland, which contains, inter alia, complete storage management and customer accounting programs. This software package can also run on the external computer.

The installation sites of the device for dispensing goods according to the invention essentially need only have access to an electrical connection, and otherwise can be selected freely according to marketing aspects. The device according to the invention makes it possible even to supply remote areas with a current offer of (rental) goods with the minimum of personnel expenditure. The anonymous access to the goods considerably reduces the often present fear which is to be overcome, as a result of which the device for dispensing goods according to the invention is particularly suitable as a rental machine, especially for goods which are sensitive in this area, such as videocassettes. A high level of operating reliability is ensured by the concept according to the invention and the cashless transactions.

As already mentioned, the device for dispensing goods according to the present invention preferably has the external form of an advertisement pillar. Besides the compact construction, amongst other things this has the advantage that large areas are available for advertising the goods on offer or also for other products. The device may also be additionally provided with electronic advertising means such as, for example, moving text, screens and the like, which draw attention to the goods on offer. These advertising means may be controllable, for example, also by the operating panel in order to be able to call up information selectively, for example. The advertising areas may also be protected by means of transparent covering windows or wings. Furthermore, it is of course possible also to provide several goods output chutes, or possibly even a separate chute for returning the goods, whereupon then the transport means and the storage magazine would have to be suitably adapted. The column-shaped housing is of course provided with a door or the like, through which the service personnel have access to the interior. It would of course also be possible, with appropriate programming of the computer, to load the goods storage magazine also via the goods chute. The goods themselves could be automatically marked in a manner which indicates the total borrowing duration and thus permits the service personnel to recognize frequently borrowed goods, and exchange them if necessary.

A particularly expedient embodiment of the goods storage magazine is represented in FIG. 7. The storage magazine, denoted overall by 70, is, like the magazine 7 of FIG. 2, of drum-shaped external design; however, the individual storage cells 71 for the goods 8 are here not located on several separate levels, rather they are arranged on a single helix. Details can be seen from the sectional representation of FIG. 8.

Analogous to the exemplary embodiment of FIG. 2, the threaded spindle 14 is arranged so as to be coaxially fixed in the cylindrical housing 1 of the device for dispensing goods. Rotatably seated on the threaded spindle 14 is a supporting member 72 equipped with a corresponding counter-thread, which bears a freely rotatable supporting arm 74 via a ball bearing 73. Supported on this supporting member 72 is a supporting tube 75, which is joined at its top end to a spindle nut 76 which is in engagement with the threaded spindle 14. This spindle nut bears a supporting disc 77, which forms the top closure of the magazine and on which the shell of the magazine 70 is suspended. The latter is formed by a web 78 winding helically around the threaded spindle 14, and which merges at the bottom end of the magazine into a bottom ring 79. Fastened on the bottom ring 79 is a toothed wheel 80, into which a pinion 81 of a motor 82 which is self-locking or is provided with a brake engages, which motor is in turn fastened to the supporting arm 74. Two annular discs 83 and 84 close off the magazine at the bottom. A support 85 is arranged so as to be fixed in the housing 1 parallel to the threaded spindle 14. This support extends through the supporting arm 74 and projects up approximately up to half the height of the housing 1. It bears at its top end a bearing block 86, on which transport means in the form of a hydraulic or pneumatic gripping device is mounted, indicated here only symbolically by the dot-dashed line 90.

As evident from FIG. 7, holding elements 88 are placed between each two successive windings of the helical web 78. These elements, of which only three are shown representatively in FIG. 7, maintain a mutual distance between the web windings on the one hand, and thus provide the whole thing with the necessary stability, and on the other hand form between them the aforementioned storage cells 71 for the goods to be accommodated, for example just such videocassettes 8. The holding elements 88 are shown in slightly greater detail in FIG. 14.

With the aid of the single motor 82, on the one hand the storage magazine 70 can be turned to any arbitrary angular position relative to the reference plane defined by the support 85 and the spindle 14, and on the other hand can be displaced vertically upwards and downwards at the same time. The topmost position is indicated with a dot-dashed line in FIG. 8 and denoted by the reference numeral 70,. The pitch of the threaded spindle 14 is the same as the pitch of the helical web 78. In this manner, by suitable rotation of the magazine 70, each individual one of its storage cells 71 can be selectively brought into a position which allows the access (removal or loading) by the transport means 90. The motor 82 is again controlled, as already in the first exemplary embodiment, by the computer not shown here. For route optimization and achieving the shortest possible average access time, in the rest position the magazine is preferably located approximately in the middle between its two extreme positions.

FIGS. 9 and 10 show the transport means 90 in slightly greater detail. In this exemplary embodiment, two parallel supports 85 are provided, on which the bearing block 86 is mounted. The latter comprises a hydraulic cylinder 91 with a piston rod 92 which is radially displaceable with respect to the magazine 70 and on the end of which a gripping system 93 with two claws **93*a* and 93*b*, which can be moved hydraulically towards one another and away from one another vertically, is fastened. The goods can be picked up by the gripping system 93 and transported by means of the hydraulic cylinder 91 radially outwards from the respective storage cell 71 to the goods chute 200, or vice versa, as is shown in greater detail in FIGS. 11–13. Depending on the type of goods 8**, instead of the vertically operating gripping system, a horizontally operating gripping system can also be provided.

Figure 11:
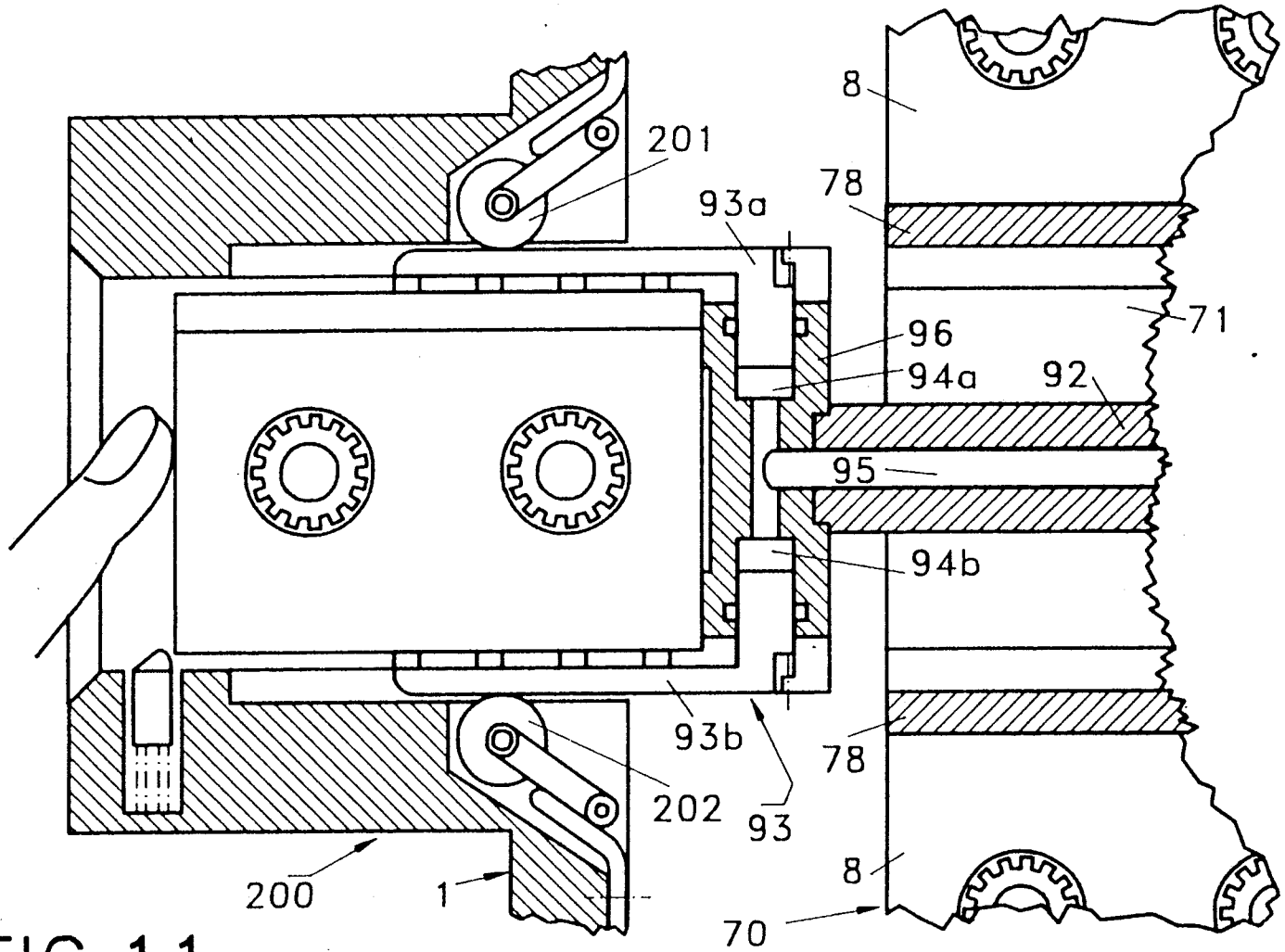
Figure 12:
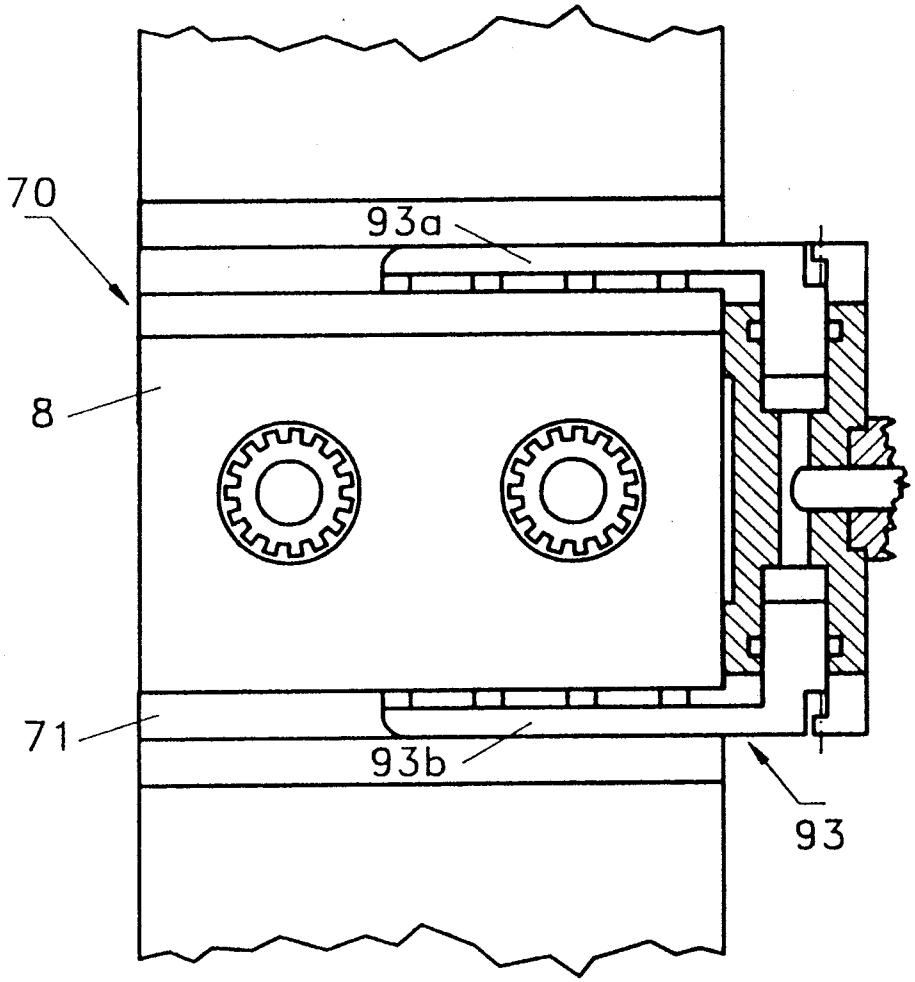
Figure 12:
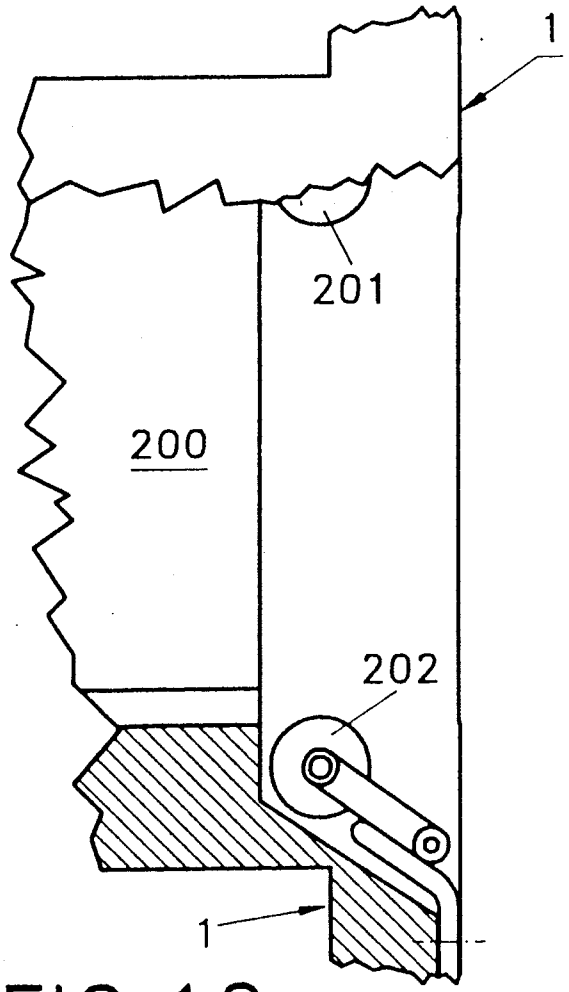
Figure 13:
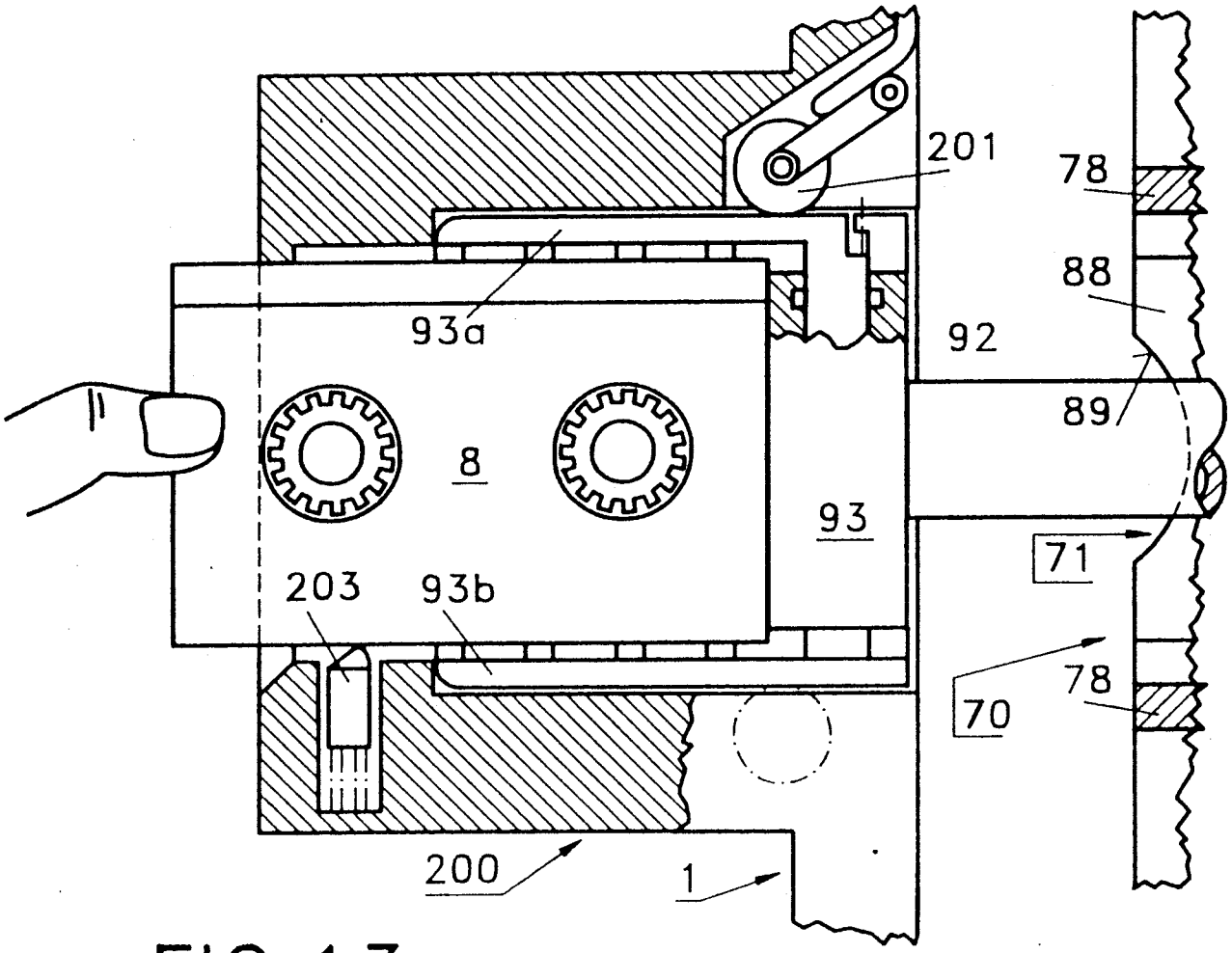

FIG. 11 shows the section of the wall of housing 1 of the device provided with the goods chute 200 as well as the section of the storage magazine 70 which is immediately adjacent radially inwards to the goods chute and which has three superjacent storage cells 71 which are each separated by one winding of the web 78. Two, preferably resiliently mounted, rollers 201 and 202 as well as a resiliently mounted detent and positioning cam 203 are provided in the goods chute 200. A videocassette 8 is represented immediately after its insertion into the goods chute 200. The gripping system 93, which either waited in the position shown for the insertion of a cassette 8, or has just been moved into this position, has gripped the cassette 8 and is now ready to be moved radially inwards to transport the cassette into the free storage cell 71 behind it. FIG. 12 shows the cassette after this transport movement.

For the goods output from the storage magazine 70 to the goods chute 200, all movements take place in reverse order. Starting from the position according to FIG. 12, the cassette 8 is gripped and brought into the position shown in FIG. 13 by means of the hydraulic cylinder 91, this position being radially slightly further out than that in FIG. 11 so that the cassette projects slightly out of the goods chute 200 and can easily be removed. Furthermore, a niche 89 in the holding elements 88 can be seen in FIG. 13 which facilitates the manual removal of the videocassettes from the storage cell 71, for example by the service personnel.

The construction of the gripping system 93 is clear from FIG. 11. The two claws 93*a* and 93*b* are mounted so as to be radially movable with their piston-shaped ends (not shown) in two diametral bores 94*a* and 94*b* of a plate 96, and the bores are subjected to a pressure medium via a line system 95 extending through the piston rod 92. When this is subjected to pressure by a pump (not shown) or the like, the two claws 93*a* and 93*b* move apart and thus open. When the pressure is reduced, they close correspondingly and in this manner clamp the cassette fast between them. It is of course possible for the gripping system 93 to be driven pneumatically, electrically or otherwise too.

FIGS. 15 and 16 show an example of how the goods, here in the form of videocassettes 8, can be held in the storage cells 71 of the storage magazine 70. For this purpose, the holding elements 88 enclosing the storage cells between them are designed with an approximately spherical detent element 88*a* which projects into the storage cells 71 and which can be pressed inwards resiliently (position 88*a'* indicated with a dot-dashed line). This detent element 88*a* is arranged so that, with a correctly inserted videocassette 8, it engages either into one of the drive openings 8*a* or into an opening 8*b* (FIG. 16) specifically provided for this purpose in the cassette housing, and thus resiliently fixes the cassette. When the cassette is pushed in and when it is removed, the detent element glides back resiliently in each case temporarily. The resilient detent element may be provided, as illustrated, in each case only on one side, or also on both sides of the holding elements 88. In the latter case, the goods would then be fixed from both sides. Alternatively, an analogous resilient detent element may also be provided at the top side or at the bottom side of the storage cells, and correspondingly secure the goods from the top and/or from the bottom.

Figures 17, 18, 19:
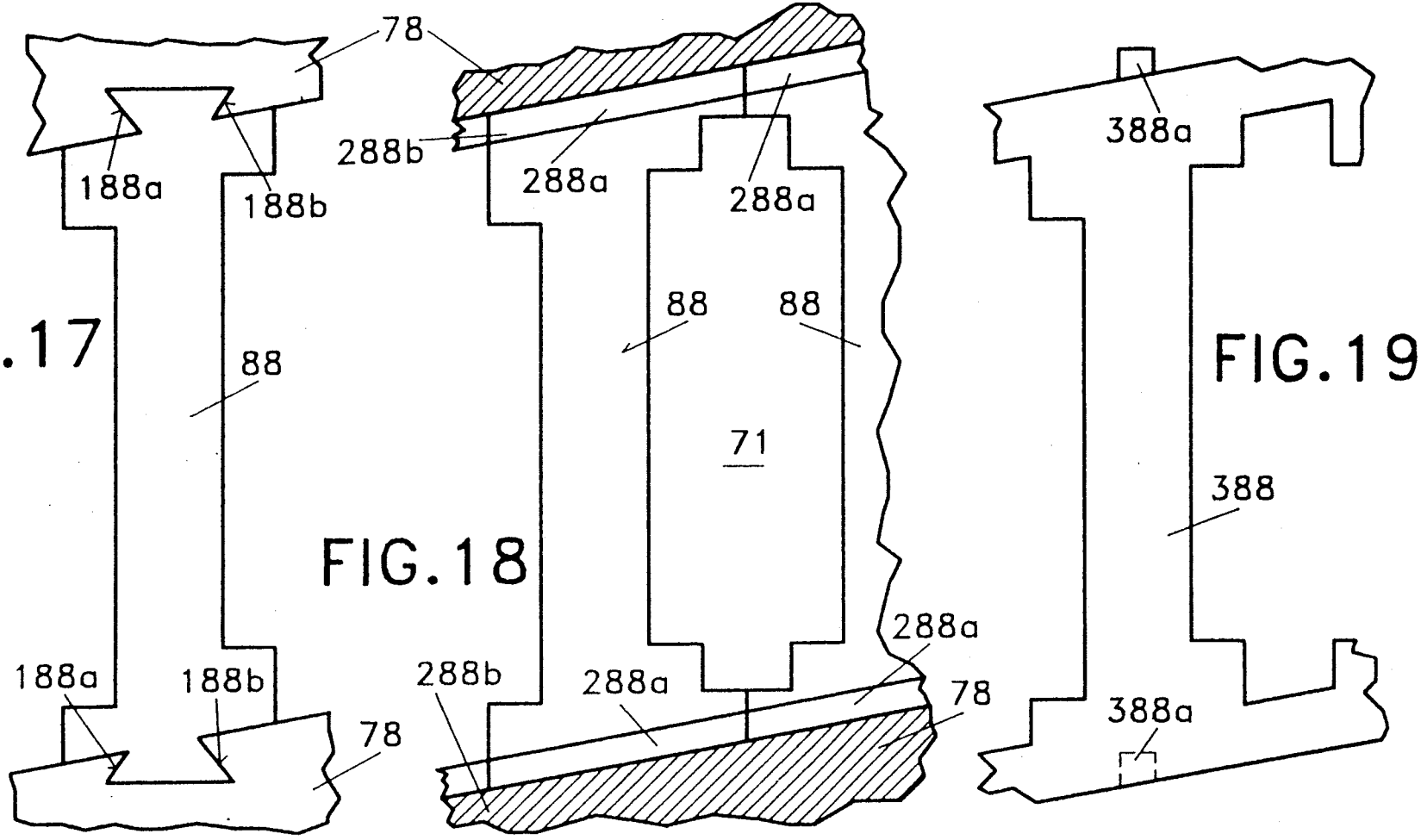

FIGS. 17–19 illustrate how the holding elements 88 can be fastened between or on the individual windings of the helical web 78 of the storage magazine. According to FIG. 17, the web 78 and the holding elements 88 are provided with dovetail joints 188*a/b* running radially with respect to the threaded spindle 14, so that the holding elements 88 can be radially inserted or removed individually. According to FIG. 18, dovetail joints 288*a/b* are likewise provided, but these do not run radially, but in the direction of the web 78. Individual holding elements 88 are thus threaded on one after the other so to speak. FIG. 19 shows that in each case two, three or more holding elements can be combined to form a multiple holding element 388. The latter may be fastened to the web 78 by means of a mortise-and-tenon joint 388*a*, for example.

FIGS. 20–24 illustrate diverse construction possibilities of the storage magazine 70. FIG. 20 again shows the already described construction according to FIG. 17, the stability of the drum-shaped magazine 70 being achieved by the individual holding elements 88 placed radially between the web windings 78. In the alternative according to FIG. 22, the individual windings of the helical web 78 are connected and braced by a row of essentially vertical transverse webs 78*a*, there being arranged inside the storage cells 71, formed by in each case two web windings 78 and two transverse webs 78*a*, also adaptors or goods holding elements 488 adapted in each case to the form of the goods to be received.

In the variant according to FIG. 21 and the associated sectional representation of FIG. 23, the storage magazine 70 comprises a self-supporting shell 170 with access openings 172 for the transport means 90. In this arrangement, the storage cells 171 are fastened outside on the shell 170, by means of screws 173 for example.

FIGS. 25 and 26, as well as the associated sectional representations of FIGS. 27 and 28, show two variants of embodiments of the external appearance of the device for dispensing goods according to the invention. The variant according to FIG. 25 corresponds essentially to that of FIG. 1, with the difference that the operating panel is here accommodated in a console 103 projecting out of the housing wall 1, the keypad 3 and the insertion slot 5 being coverable by a sliding door 103*a*. The display is realized by a screen 104, which may be designed as a cathode ray tube, liquid crystal display or a plasma screen.

The exemplary embodiment of FIG. 26 differs primarily by virtue of the prismatic shape of its housing 101, as well as by a visor panel 105.

As can be seen from FIG. 27, it is also possible for the housing 1 to be composed of several segments (shell parts) 101*a*–101*c*, which are joined to one another by bars 101*d* or the like.

It is not absolutely necessary for the device for dispensing goods according to the invention to have its own housing, but rather it is also possible, as can be seen in FIGS. 29 and 30, for it to be included (stationary or mobile) in an existing housing or construction. Apart from its own housing which is omitted, the device corresponds to that of FIG. 8 or FIG. 25, identical parts being denoted by the same reference numerals. The threaded spindle 14 is here anchored in the floor 301 and in the ceiling 302 of a builing, denoted overall by 300; the operating console 103 is arranged in the front wall 303, which may be made of bulletproof glass or metal for example. The two lateral continuations of the front wall of the building 300 are denoted by 304 and 305, the two side walls are denoted by 306 and 307, and the rear wall provided with an access door 308 is denoted by 309.

FIGS. 31 and 32 show a similar arrangement or design of the device for dispensing goods, the screen 104 also being provided in the front wall 313 of the building 300 beside the operating console 103, however, and in addition a visor panel 105 also being provided, similar to FIG. 26.

FIG. 34 shows a similar configuration as FIG. 29, however with a screen 104 as a display, similar to FIG. 31. The front side 303 of the building 300 is again made of bulletproof glass, for example.

FIG. 33 shows a section analogous to FIG. 32 through a further alternative embodiment of the device. In this arrangement, the outline of the housing or building 400 is adapted to the drum-shape of the storage magazine 70 in such a manner that the, for example glass, front 403 of the building 400 has an approximately semicircular cross-section, and thus ensures optimum accessibility from different sides. The operating console arranged in the front 403 is again denoted by 103.

FIGS. 35–37 illustrate how the device for dispensing goods according to the invention can be integrated in various advertising constructions. In FIG. 35, the advertising construction takes the form of a hand 500, the device 501 itself taking up the position of the index finger. According to FIG. 36, the advertising construction is a seated dog 600, the operating console 603 of the device for dispensing goods 601 being arranged on the back of the dog. The arrangement of the device 601 in the body of the dog 600 is evident from the sectional representation of FIG. 37.

FIG. 38 shows how the device for dispensing goods according to the invention can also be designed as a suspended column, the housing 701 of the device being mounted on the ceiling 702 of a room. The operating console is again denoted by 103. In FIG. 39, the housing 801 of the device is designed as a column which connects the floor 802 and ceiling 803 of a room.

Finally, FIGS. 40–46 show that it is also possible to arrange two or three (or more) devices for dispensing goods 1001–1010 in each case in a common housing 1011–1014. In this arrangement, the respective operating consoles 103 can be arranged either directly on the associated devices (FIGS. 40 and 41) or in each case between these (FIGS. 42 and 43). FIGS. 44–46 in each case show a view of the double and triple devices for dispensing goods. It is possible to realize compact and attractive goods rental centres with these embodiment variants, which may contain, for example, different groups of goods divided up thematically.

In the above described embodiment variants, the threaded spindle(s) 14 is/are either anchored in the housing of the device or in a building accommodating the device. It is, however, of course also possible for the threaded spindle to be mounted in a U-support or the like, in order to form an independent unit (module) in this way. It is thus possible to achieve a greater design freedom. Moreover, it is not absolutely necessary for the drive motor for the storage magazine to be arranged at the bottom, it could just as easily be located further up or also outside the periphery of the magazine. In addition, the drive of the magazine can also be realized differently than shown, for example by means of a belt-drive or a chain-drive.

I claim:

1. A device for dispensing goods, comprising:

a housing;

a goods storage carousel magazine contained in the housing and holding a plurality of goods;

a goods output opening in the housing;

an electronically controllable goods transport means for transporting the goods from the goods storage carousel magazine to the goods output opening;

an operating panel means operatable by a customer for selecting a desired one of the plurality of goods;

a control device interacting with the operating panel means and controlling the goods transport means to transport the desired one of the plurality of goods;

said goods storage carousel magazine having a plurality of goods storage cells being arranged along a helix, each storage cell holding one of said plurality of goods;

said goods storage carousel magazine comprising a helically wound web and a plurality of modular holding elements secured between individual windings of said web, wherein adjacent ones of said modular holding elements cooperate with said individual windings to form said storage cells;

said goods storage carousel magazine being rotatable about a vertical axis and adjustable with regard to height along the vertical axis; and a control means interacting with said operating panel for rotating and adjusting said goods storage carousel magazine so as to locate the storage cell of the selected one of the plurality of goods in register with the goods output opening;

wherein said goods storage carousel magazine is rotatably and height adjustably driven by a single motor.

2. A device according to claim 1, characterized in that an identification device, interacting with the control device and the electronically controllable goods transport means, is provided for recognizing identification information attached to the goods.

3. A device according to claim 2, characterized in that the control device controls the electronically controllable transport means on the basis of the identification information.

4. A device according to claim 1, characterized in that automatic storage management system means is provided for monitoring the operation of the goods transport means and for registering individual movements of the goods based on the monitored operation of the goods transport means.

5. A device according to claim 4, characterized in that automatic customer accounting system means are provided for individually registering, for each particular customer, the movements of the goods to the particular customer.

6. A device according to claim 1, characterized in that an automatic access control and registration system, which reads individual, recordable data carriers provided on each of the plurality of goods and which records individual data relevant for dispensing of the goods on the respective individual data carrier, is connected to the control device.

7. A device according to claim 6, characterized in that the access control and registration system selectively controls the access to certain goods or groups of goods on the basis of selectioning information stored on the individual data carriers.

8. A device for dispensing and receiving goods comprising:

a housing comprising opening means for permitting passage of goods into and out of the housing;

a storage magazine means within the housing for holding a plurality of stored goods, wherein the storage magazine means comprises a helically wound web having a plurality of convolutions and wherein a plurality of modular holding elements are connected between adjacent ones of the plurality of convolutions so as to form storage cells for the stored goods;

panel means operable by a customer for selecting one of the plurality of stored goods to be conveyed from the storage magazine means to the opening means;

electronically controlled transport means for conveying the selected one of the plurality of stored goods from the storage magazine means to the opening means and for conveying received goods deposited by a customer in the opening means from the opening means to the storage magazine means;

wherein the stored and received goods comprise videotapes.

9. A device for dispensing and receiving goods comprising:

a housing comprising opening means for permitting passage of goods into and out of the housing;

a storage magazine means within the housing for holding a plurality of stored goods;

panel means operable by a customer for selecting one of the plurality of stored goods to be conveyed from the storage magazine means to the opening means;

electronically controlled transport means for conveying the selected one of the plurality of stored goods from the storage magazine means to the opening means and for conveying received goods deposited by a customer in the opening means from the opening means to the storage magazine means, wherein the transport means comprises a hydraulic cylinder and piston assembly which is operative to convey the stored goods to the opening means from the storage magazine means and to convey the received goods to the storage magazine means from the opening means and further comprises gripping means for gripping the videotapes attached to a piston rod of the hydraulic cylinder and piston assembly;

wherein the stored and received goods comprise videotapes.

10. A device as recited in claim 9, wherein the gripping means comprise a pair of hydraulically actuated claws.

11. A device as recited in claim 10, wherein the claws are movable towards and away from each other.

* * * * *